US012043361B1

(12) United States Patent
Ernst et al.

(10) Patent No.: US 12,043,361 B1
(45) Date of Patent: Jul. 23, 2024

(54) EXHAUST HANDLING SYSTEMS FOR MARINE VESSELS AND RELATED METHODS

(71) Applicant: MARATHON PETROLEUM COMPANY LP, Findlay, OH (US)

(72) Inventors: Stephen Daniel Ernst, Findlay, OH (US); James A. Tomlinson, Findlay, OH (US)

(73) Assignee: MARATHON PETROLEUM COMPANY LP, Findlay, OH (US)

( * ) Notice: Subject to any disclaimer, the term of this patent is extended or adjusted under 35 U.S.C. 154(b) by 0 days.

(21) Appl. No.: 18/369,485

(22) Filed: Sep. 18, 2023

Related U.S. Application Data

(60) Provisional application No. 63/488,574, filed on Mar. 6, 2023, provisional application No. 63/485,886, filed on Feb. 18, 2023.

(51) Int. Cl.
*B63H 21/32* (2006.01)
*B63H 20/24* (2006.01)
(Continued)

(52) U.S. Cl.
CPC ..... *B63H 21/32* (2013.01); *F01N 13/004* (2013.01); *F01N 13/085* (2013.01); *B63H 20/24* (2013.01);
(Continued)

(58) Field of Classification Search
CPC combination set(s) only.
See application file for complete search history.

(56) References Cited

U.S. PATENT DOCUMENTS 2,626,627 A 1/1953 Jung et al.
2,864,252 A 12/1958 Schaschl
(Continued)

FOREIGN PATENT DOCUMENTS

AU 2010241217 11/2010
AU 2013202839 5/2014
(Continued)

OTHER PUBLICATIONS

Skelton et al., Onboard Refueling Vapor Recovery Systems Analysis of Widespread Use, Nescaum, Boston MA, Aug. 20, 2007.
(Continued)

*Primary Examiner* — Binh Q Tran
(74) *Attorney, Agent, or Firm* — Womble Bond Dickinson (US) LLP

(57) ABSTRACT

An embodiment of an exhaust handling system for a marine vessel includes a cap connected to a top end portion of an exhaust stack of the marine vessel to form an enclosure at least partially surrounding an outlet of an exhaust pipe extending through the exhaust stack. In addition, the exhaust handling system includes a collection pipe in fluid communication with the cap such that the collection pipe is to receive exhaust from the enclosure, and a coupling connected to the collection pipe that is to connect to an exhaust cleaning assembly. The exhaust cleaning system includes a tank to receive the exhaust. The cap at least partially defines a first flow path for the exhaust that extends from the enclosure to the atmosphere. The collection pipe at least partially defines a second flow path for the exhaust that extends from the enclosure to the coupling via the collection pipe.

30 Claims, 14 Drawing Sheets

(51) Int. Cl.

| | |
|---|---|
| ***B63H 21/34*** | (2006.01) |
| ***F01N 1/08*** | (2006.01) |
| ***F01N 1/16*** | (2006.01) |
| ***F01N 3/023*** | (2006.01) |
| ***F01N 3/28*** | (2006.01) |
| ***F01N 13/00*** | (2010.01) |
| ***F01N 13/08*** | (2010.01) |
| ***F01N 13/18*** | (2010.01) |

(52) U.S. Cl.

CPC ..... *B63H 20/245* (2013.01); *B63H 21/34* (2013.01); *F01N 1/085* (2013.01); *F01N 1/161* (2013.01); *F01N 1/163* (2013.01); *F01N 3/0235* (2013.01); *F01N 3/0236* (2013.01); *F01N 3/2892* (2013.01); *F01N 13/082* (2013.01); *F01N 13/1816* (2013.01); *F01N 13/1822* (2013.01); *F01N 2240/22* (2013.01); *F01N 2490/12* (2013.01); *F01N 2490/16* (2013.01); *F01N 2490/18* (2013.01); *F01N 2490/20* (2013.01); *F01N 2590/02* (2013.01); *F01N 2590/022* (2013.01)

(56) References Cited

U.S. PATENT DOCUMENTS

| | | | | |
|---|---|---|---|---|
| 3,087,311 | A | | 4/1963 | Rousseau |
| 3,303,525 | A | | 2/1967 | Peoples |
| 3,398,071 | A | | 8/1968 | Bagno |
| 3,504,686 | A | | 4/1970 | Cooper et al. |
| 3,593,555 | A | | 7/1971 | Grosko |
| 3,608,869 | A | | 9/1971 | Woodle |
| 3,672,180 | A | | 6/1972 | Davis |
| 3,725,669 | A | | 4/1973 | Tatum |
| 3,807,433 | A | | 4/1974 | Byrd |
| 3,809,113 | A | | 5/1974 | Grove |
| 3,925,592 | A | | 12/1975 | Webb |
| 3,961,493 | A | | 6/1976 | Nolan, Jr. |
| 4,010,779 | A | | 3/1977 | Pollock et al. |
| 4,073,303 | A | | 2/1978 | Foley, Jr. |
| 4,109,677 | A | | 8/1978 | Burnside |
| 4,202,351 | A | | 5/1980 | Biche |
| 4,229,064 | A | | 10/1980 | Vetter et al. |
| 4,242,533 | A | | 12/1980 | Cott |
| 4,289,163 | A | | 9/1981 | Pierson |
| 4,294,378 | A | | 10/1981 | Rabinovich |
| 4,320,775 | A | | 3/1982 | Stirling et al. |
| 4,357,576 | A | | 11/1982 | Hickam et al. |
| 4,420,008 | A | | 12/1983 | Shu |
| 4,457,037 | A | | 7/1984 | Rylander |
| 4,481,474 | A | | 11/1984 | Gerrit |
| 4,488,570 | A | | 12/1984 | Jiskoot |
| 4,630,685 | A | | 12/1986 | Huck et al. |
| 4,690,587 | A | | 9/1987 | Petter |
| 4,744,305 | A | | 5/1988 | Lim et al. |
| 4,788,093 | A | | 11/1988 | Murata et al. |
| 4,794,331 | A | | 12/1988 | Schweitzer, Jr. |
| 4,848,082 | A | * | 7/1989 | Takahashi ..... F01N 3/28 440/89 R |
| 4,897,226 | A | | 1/1990 | Hoyle et al. |
| 4,904,932 | A | | 2/1990 | Schweitzer, Jr. |
| 4,964,732 | A | | 10/1990 | Cadeo et al. |
| 5,050,064 | A | | 9/1991 | Mayhew |
| 5,095,977 | A | | 3/1992 | Ford |
| 5,129,432 | A | | 7/1992 | Dugger |
| 5,191,537 | A | | 3/1993 | Edge |
| 5,367,882 | A | | 11/1994 | Lievens et al. |
| 5,383,243 | A | | 1/1995 | Thacker |
| 5,469,830 | A | | 11/1995 | Gonzalez |
| 5,533,912 | A | | 7/1996 | Fillinger |
| 5,562,133 | A | | 10/1996 | Mitchell |
| 5,595,709 | A | | 1/1997 | Klemp |
| 5,603,360 | A | | 2/1997 | Teel |
| 5,627,749 | A | | 5/1997 | Waterman et al. |
| 5,661,623 | A | | 8/1997 | McDonald |
| 5,783,916 | A | | 7/1998 | Blackburn |
| 5,814,982 | A | | 9/1998 | Thompson et al. |
| 5,832,967 | A | | 11/1998 | Andersson |
| 5,873,916 | A | | 2/1999 | Cemenska et al. |
| 5,895,347 | A | | 4/1999 | Doyle |
| 5,906,648 | A | | 5/1999 | Zoratti et al. |
| 5,906,877 | A | | 5/1999 | Popper et al. |
| 5,939,166 | A | | 8/1999 | Cheng et al. |
| 5,962,774 | A | | 10/1999 | Mowry |
| 5,973,593 | A | | 10/1999 | Botella |
| 5,993,054 | A | | 11/1999 | Tan et al. |
| 6,022,421 | A | | 2/2000 | Bath |
| 6,050,844 | A | | 4/2000 | Johnson |
| 6,065,903 | A | | 5/2000 | Doyle |
| 6,077,340 | A | | 6/2000 | Doyle |
| 6,077,418 | A | | 6/2000 | Iseri et al. |
| 6,098,601 | A | | 8/2000 | Reddy |
| 6,111,021 | A | | 8/2000 | Nakahama et al. |
| 6,149,351 | A | | 11/2000 | Doyle |
| 6,186,193 | B1 | | 2/2001 | Phallen et al. |
| 6,243,483 | B1 | | 6/2001 | Petrou et al. |
| 6,333,374 | B1 | | 12/2001 | Chen |
| 6,346,813 | B1 | | 2/2002 | Kleinberg |
| 6,383,237 | B1 | | 5/2002 | Langer et al. |
| 6,427,384 | B1 | | 8/2002 | Davis, Jr. |
| 6,478,353 | B1 | | 11/2002 | Barrozo |
| 6,679,302 | B1 | | 1/2004 | Mattingly et al. |
| 6,719,921 | B2 | | 4/2004 | Steinberger et al. |
| 6,799,883 | B1 | | 10/2004 | Urquhart et al. |
| 6,834,531 | B2 | | 12/2004 | Rust |
| 6,840,292 | B2 | | 1/2005 | Hart et al. |
| 6,851,916 | B2 | | 2/2005 | Schmidt |
| 6,980,647 | B1 | | 12/2005 | Daugherty et al. |
| 6,987,877 | B2 | | 1/2006 | Paz-Pujalt et al. |
| 7,032,629 | B1 | | 4/2006 | Mattingly et al. |
| 7,091,421 | B2 | | 8/2006 | Kukita et al. |
| 7,186,321 | B2 | | 3/2007 | Benham |
| 7,258,710 | B2 | | 8/2007 | Caro et al. |
| 7,275,366 | B2 | | 10/2007 | Powell et al. |
| 7,294,913 | B2 | | 11/2007 | Fischer et al. |
| 7,385,681 | B2 | | 6/2008 | Ninomiya et al. |
| 7,444,996 | B2 | | 11/2008 | Potier |
| 7,459,067 | B2 | | 12/2008 | Dunn et al. |
| 7,564,540 | B2 | | 7/2009 | Paulson |
| 7,631,671 | B2 | | 12/2009 | Mattingly et al. |
| 7,729,561 | B1 | | 6/2010 | Boland et al. |
| 7,749,308 | B2 | | 7/2010 | McCully |
| 7,810,988 | B2 | | 10/2010 | Kamimura et al. |
| 7,815,744 | B2 | | 10/2010 | Abney et al. |
| 7,832,338 | B2 | | 11/2010 | Caro et al. |
| 7,879,204 | B2 | | 2/2011 | Funahashi |
| 8,075,651 | B2 | | 12/2011 | Caro et al. |
| 8,282,265 | B2 | | 10/2012 | Breithhaupt |
| 8,299,811 | B2 | | 10/2012 | Wing |
| 8,312,584 | B2 | | 11/2012 | Hodde |
| 8,327,631 | B2 | | 12/2012 | Caro et al. |
| 8,368,405 | B2 | | 2/2013 | Siebens |
| 8,376,432 | B1 | | 2/2013 | Halger et al. |
| 8,402,746 | B2 | | 3/2013 | Powell et al. |
| 8,413,484 | B2 | | 4/2013 | Lubkowitz |
| 8,414,781 | B2 | | 4/2013 | Berard |
| 8,577,518 | B2 | | 11/2013 | Linden et al. |
| 8,597,380 | B2 | | 12/2013 | Buchanan |
| 8,632,359 | B2 | | 1/2014 | Grimm |
| 8,647,162 | B2 | | 2/2014 | Henriksson et al. |
| 8,748,677 | B2 | | 6/2014 | Buchanan |
| 8,808,415 | B2 | | 8/2014 | Caro et al. |
| 8,979,982 | B2 | | 3/2015 | Jordan et al. |
| 9,038,855 | B2 | | 5/2015 | Lurcott et al. |
| 9,162,944 | B2 | | 10/2015 | Bennett et al. |
| 9,175,235 | B2 | | 11/2015 | Kastner |
| 9,222,480 | B2 | | 12/2015 | Younes et al. |
| 9,310,016 | B2 | | 4/2016 | Hodde |
| 9,329,066 | B2 | | 5/2016 | Skarping |
| 9,363,462 | B2 | | 6/2016 | Yoel |
| 9,388,350 | B2 | | 7/2016 | Buchanan |
| 9,518,693 | B2 | | 12/2016 | Hodde |
| 9,550,247 | B2 | | 1/2017 | Smith |

(56) References Cited

U.S. PATENT DOCUMENTS 9,643,135 B1 5/2017 Mazzei et al.
9,945,333 B2 4/2018 Kopinsky
10,001,240 B1 6/2018 Dray et al.
10,012,340 B1 7/2018 Dray et al.
10,024,768 B1 7/2018 Johnsen
10,094,508 B1 10/2018 Dray et al.
10,168,255 B1 1/2019 Johnsen
10,196,243 B1 2/2019 Wells
10,197,206 B1 2/2019 Dray et al.
10,247,643 B1 4/2019 Johnsen
10,287,940 B2 5/2019 Tonsich
10,345,221 B1 7/2019 Silverman
10,364,718 B2 7/2019 Eddaoudi et al.
10,386,260 B2 8/2019 Dudek
10,408,377 B1 9/2019 Dray et al.
10,486,946 B1 11/2019 Wells
10,501,385 B1 12/2019 Buckner et al.
10,563,555 B2 2/2020 Hamad
10,570,581 B2 2/2020 Faivre
10,605,144 B2 * 3/2020 Kobayashi ..... F01N 3/18
10,633,830 B2 4/2020 Shibamori
10,655,774 B1 5/2020 Dray et al.
10,657,443 B2 5/2020 Araujo et al.
10,688,686 B2 6/2020 Fadhel et al.
10,756,459 B2 8/2020 Jongsma
10,833,434 B1 11/2020 Tassell, Jr.
10,943,357 B2 3/2021 Badawy et al.
10,948,471 B1 3/2021 MacMullin et al.
10,953,960 B1 3/2021 Sharp
10,962,437 B1 3/2021 Nottrott et al.
10,970,927 B2 4/2021 Sharp
10,990,114 B1 4/2021 Miller
10,997,707 B1 5/2021 Katz et al.
11,010,608 B2 5/2021 Adam et al.
11,112,308 B2 9/2021 Kreitinger et al.
11,125,391 B2 9/2021 Al Khowaiter et al.
11,132,008 B2 9/2021 Miller
11,164,406 B2 11/2021 Meroux et al.
11,221,107 B2 1/2022 Du et al.
11,247,184 B2 2/2022 Miller
11,325,687 B1 5/2022 Sharp
11,332,070 B2 5/2022 Holden et al.
11,345,455 B2 * 5/2022 Sharp ..... B63B 1/04
11,416,012 B2 8/2022 Miller
11,428,600 B2 8/2022 Dankers et al.
11,447,877 B1 9/2022 Ell
11,559,774 B2 1/2023 Miller
11,565,221 B2 1/2023 Miller
11,578,638 B2 2/2023 Thobe
11,578,836 B2 2/2023 Thobe
11,596,910 B2 3/2023 Miller
11,607,654 B2 3/2023 Miller
11,655,748 B1 5/2023 Thobe
11,655,940 B2 5/2023 Thobe
11,662,750 B2 5/2023 Miller
11,686,070 B1 6/2023 Jordan et al.
11,715,950 B2 8/2023 Miller et al.
11,720,526 B2 8/2023 Miller et al.
11,739,679 B2 8/2023 Thobe
11,752,472 B2 9/2023 Miller
11,754,225 B2 9/2023 Thobe
11,774,042 B2 10/2023 Thobe
11,794,153 B2 10/2023 Miller
11,807,945 B2 11/2023 Ell
11,808,013 B1 11/2023 Jordan et al.
11,815,227 B2 11/2023 Thobe
11,920,504 B2 3/2024 Thobe
11,965,317 B2 4/2024 Jordan
2002/0014068 A1 2/2002 Mittricker et al.
2002/0178806 A1 12/2002 Valentine
2003/0041518 A1 3/2003 Wallace et al.
2003/0121481 A1 7/2003 Dodd et al.
2003/0158630 A1 8/2003 Pham et al.
2003/0167660 A1 9/2003 Kondou
2003/0178994 A1 9/2003 Hurlimann et al.
2003/0188536 A1 10/2003 Mittricker
2003/0197622 A1 10/2003 Reynard et al.
2003/0227821 A1 12/2003 Bae et al.
2004/0057334 A1 3/2004 Wilmer et al.
2004/0058597 A1 * 3/2004 Matsuda ..... F01N 1/02
440/89 J
2004/0067126 A1 4/2004 Schmidt
2004/0125688 A1 7/2004 Kelley et al.
2004/0249105 A1 12/2004 Nolte et al.
2004/0265653 A1 12/2004 Buechi et al.
2005/0007450 A1 1/2005 Hill et al.
2005/0058016 A1 3/2005 Smith et al.
2005/0146437 A1 7/2005 Ward
2005/0150820 A1 7/2005 Guo
2005/0154132 A1 7/2005 Hakuta et al.
2005/0284333 A1 12/2005 Falkiewicz
2006/0125826 A1 6/2006 Lubkowitz
2006/0278304 A1 12/2006 Mattingly et al.
2007/0175511 A1 8/2007 Doerr
2008/0092625 A1 4/2008 Hinnrichs
2008/0113884 A1 5/2008 Campbell et al.
2008/0115834 A1 5/2008 Geoffrion et al.
2008/0149481 A1 6/2008 Hurt
2008/0283083 A1 11/2008 Piao
2009/0009308 A1 1/2009 Date et al.
2009/0107111 A1 4/2009 Oliver
2009/0175738 A1 7/2009 Shaimi
2009/0183498 A1 7/2009 Uchida et al.
2009/0188565 A1 7/2009 Satake
2009/0197489 A1 8/2009 Caro
2010/0031825 A1 2/2010 Kemp
2010/0049410 A1 2/2010 McKee
2010/0058666 A1 3/2010 Kim
2011/0265449 A1 * 11/2011 Powell ..... B08B 15/00
60/272
2012/0092835 A1 4/2012 Miller
2012/0143560 A1 6/2012 Tabet et al.
2012/0185220 A1 7/2012 Shippen
2012/0276379 A1 11/2012 Daniels et al.
2012/0304625 A1 * 12/2012 Daikoku ..... F01N 3/046
60/276
2013/0035824 A1 2/2013 Nakamura
2013/0048094 A1 2/2013 Ballantyne
2013/0062258 A1 3/2013 Ophus
2013/0125323 A1 5/2013 Henderson
2013/0176656 A1 7/2013 Kaisser
2013/0186671 A1 7/2013 Theis
2013/0201025 A1 8/2013 Kamalakannan et al.
2013/0245524 A1 9/2013 Schofield
2013/0293884 A1 11/2013 Lee et al.
2013/0299500 A1 11/2013 McKinnon
2014/0002639 A1 1/2014 Cheben et al.
2014/0008926 A1 1/2014 Allen
2014/0062490 A1 3/2014 Neuman et al.
2014/0090379 A1 4/2014 Powell et al.
2014/0121622 A1 5/2014 Jackson et al.
2014/0158616 A1 6/2014 Govind et al.
2014/0158632 A1 6/2014 Govind et al.
2014/0171538 A1 6/2014 Daniels et al.
2014/0176344 A1 6/2014 Littlestar
2014/0190691 A1 7/2014 Vinegar
2014/0194657 A1 7/2014 Wadhwa et al.
2014/0299039 A1 10/2014 Trollux
2014/0345370 A1 11/2014 Marotta
2014/0356707 A1 12/2014 Kwon et al.
2015/0081165 A1 3/2015 Yamashita et al.
2015/0144468 A1 5/2015 Skolozdra
2015/0183102 A1 7/2015 Breschi et al.
2015/0198518 A1 7/2015 Borin et al.
2015/0244087 A1 8/2015 Wing
2015/0323119 A1 11/2015 Giunta
2016/0091467 A1 3/2016 Morris
2016/0139355 A1 5/2016 Petersen
2016/0169098 A1 6/2016 Makita
2016/0169436 A1 6/2016 Sander et al.
2016/0175634 A1 6/2016 Radian
2016/0238194 A1 8/2016 Adler et al.
2016/0252650 A1 9/2016 Hirst, Sr.
2016/0363249 A1 12/2016 Disher

(56) References Cited

U.S. PATENT DOCUMENTS

| | | | |
|---|---|---|---|
| 2016/0369930 | A1 | 12/2016 | Poe et al. |
| 2017/0051472 | A1 | 2/2017 | Mochimaru |
| 2017/0088401 | A1 | 3/2017 | Clements et al. |
| 2017/0122174 | A1* | 5/2017 | Patel ..... F01N 3/24 |
| 2017/0131728 | A1 | 5/2017 | Lambert et al. |
| 2017/0158303 | A1 | 6/2017 | Michaelis et al. |
| 2017/0248569 | A1 | 8/2017 | Lambert et al. |
| 2017/0253737 | A1 | 9/2017 | Auld et al. |
| 2017/0253738 | A1 | 9/2017 | Auld et al. |
| 2017/0253806 | A1 | 9/2017 | Auld et al. |
| 2017/0254481 | A1 | 9/2017 | Cadogan et al. |
| 2017/0259229 | A1 | 9/2017 | Chou et al. |
| 2017/0306428 | A1 | 10/2017 | Helgason et al. |
| 2017/0326474 | A1 | 11/2017 | Olovsson |
| 2017/0367346 | A1 | 12/2017 | Rees et al. |
| 2018/0002617 | A1 | 1/2018 | Umansky et al. |
| 2018/0003116 | A1 | 1/2018 | Fersman et al. |
| 2018/0037452 | A1 | 2/2018 | Gray et al. |
| 2018/0080356 | A1* | 3/2018 | Fukui ..... F01N 3/05 |
| 2018/0119882 | A1 | 5/2018 | Allidieres et al. |
| 2018/0143734 | A1 | 5/2018 | Ochenas et al. |
| 2018/0186528 | A1 | 7/2018 | Tonn |
| 2018/0223202 | A1 | 8/2018 | Fransham et al. |
| 2018/0245313 | A1 | 8/2018 | Shibamori et al. |
| 2018/0259064 | A1 | 9/2018 | McLemore |
| 2018/0312391 | A1 | 11/2018 | Borg |
| 2019/0016963 | A1 | 1/2019 | Auld et al. |
| 2019/0121373 | A1 | 4/2019 | Panigrahi |
| 2019/0367732 | A1 | 5/2019 | Helgason et al. |
| 2019/0270500 | A1* | 9/2019 | Hamaoka ..... B63H 21/32 |
| 2019/0338203 | A1 | 11/2019 | Umansky et al. |
| 2019/0359899 | A1 | 11/2019 | Umansky et al. |
| 2019/0136060 | A1 | 12/2019 | Helgason et al. |
| 2019/0368054 | A1 | 12/2019 | Gummow et al. |
| 2019/0368156 | A1 | 12/2019 | Faivre |
| 2020/0118413 | A1 | 4/2020 | Kanukurthy et al. |
| 2020/0232191 | A1 | 7/2020 | Prior |
| 2020/0245551 | A1 | 8/2020 | Hoffman et al. |
| 2020/0245552 | A1 | 8/2020 | Hoffman et al. |
| 2020/0245553 | A1 | 8/2020 | Hoffman et al. |
| 2020/0292445 | A1 | 9/2020 | Morimoto |
| 2020/0325742 | A1 | 10/2020 | Astudillo et al. |
| 2021/0053011 | A1 | 2/2021 | Sugiyama et al. |
| 2021/0062697 | A1 | 3/2021 | Yokoyama et al. |
| 2021/0073692 | A1 | 3/2021 | Saha et al. |
| 2021/0076006 | A1 | 3/2021 | O'Neill et al. |
| 2021/0123211 | A1 | 4/2021 | Miller et al. |
| 2021/0138399 | A1 | 5/2021 | Yokoyama et al. |
| 2021/0197151 | A1 | 7/2021 | Miller |
| 2021/0207772 | A1 | 7/2021 | Norton et al. |
| 2021/0215925 | A1 | 7/2021 | Kim et al. |
| 2021/0216852 | A1 | 7/2021 | Reece et al. |
| 2021/0232163 | A1 | 7/2021 | Miller |
| 2021/0232741 | A1 | 7/2021 | Ogiso et al. |
| 2021/0362637 | A1 | 11/2021 | Hanis et al. |
| 2021/0381920 | A1 | 12/2021 | Jacobsz et al. |
| 2022/0001969 | A1* | 1/2022 | Pugnetti ..... F01N 13/004 |
| 2022/0010707 | A1 | 1/2022 | Sharma et al. |
| 2022/0048606 | A1 | 2/2022 | Singh |
| 2022/0081261 | A1 | 3/2022 | Karbassi |
| 2022/0087099 | A1 | 3/2022 | Hoffman et al. |
| 2022/0154427 | A1 | 5/2022 | Misaki |
| 2022/0178114 | A1 | 6/2022 | Takahama |
| 2022/0186470 | A1 | 6/2022 | Chiba et al. |
| 2022/0213603 | A1 | 7/2022 | Al Eid et al. |
| 2022/0221368 | A1 | 7/2022 | Bergeron |
| 2022/0228345 | A1 | 7/2022 | Case et al. |
| 2022/0282651 | A1 | 9/2022 | Reynolds et al. |
| 2022/0290411 | A1 | 9/2022 | Anahara et al. |
| 2022/0343229 | A1 | 10/2022 | Gruber et al. |
| 2022/0401899 | A1 | 12/2022 | Miller |
| 2022/0404272 | A1 | 12/2022 | Kendall et al. |
| 2023/0015077 | A1 | 1/2023 | Kim |
| 2023/0061824 | A1 | 3/2023 | Ell |
| 2023/0078852 | A1 | 3/2023 | Campbell et al. |
| 2023/0129513 | A1 | 4/2023 | Miller |
| 2023/0259080 | A1 | 8/2023 | Whikehart et al. |
| 2023/0259088 | A1 | 8/2023 | Borup et al. |
| 2023/0332532 | A1 | 10/2023 | Thobe |
| 2023/0333577 | A1 | 10/2023 | Miller |
| 2023/0333578 | A1 | 10/2023 | Miller |
| 2023/0341092 | A1 | 10/2023 | Thobe |
| 2023/0347303 | A1 | 11/2023 | Miller |
| 2023/0358023 | A1 | 11/2023 | Jordan et al. |
| 2023/0366510 | A1 | 11/2023 | Thobe |
| 2023/0383416 | A1 | 11/2023 | Ell |
| 2023/0383417 | A1 | 11/2023 | Ell |
| 2023/0383418 | A1 | 11/2023 | Ell |
| 2023/0392536 | A1 | 12/2023 | Thobe |
| 2023/0399817 | A1 | 12/2023 | Jordan |
| 2023/0399818 | A1 | 12/2023 | Jordan |
| 2023/0407488 | A1 | 12/2023 | Ell |
| 2023/0415106 | A1 | 12/2023 | Miller |
| 2024/0003016 | A1 | 1/2024 | Ell |
| 2024/0060189 | A1 | 2/2024 | Ell |

FOREIGN PATENT DOCUMENTS

| | | |
|---|---|---|
| CA | 2447358 | 4/2005 |
| CA | 2702151 | 10/2007 |
| CA | 2637421 | 1/2010 |
| CA | 2642295 | 1/2010 |
| CA | 2736733 | 10/2011 |
| CA | 2958443 | 4/2017 |
| CA | 2995532 | 4/2017 |
| CA | 2916141 | 6/2017 |
| CN | 2092562 | 1/1992 |
| CN | 200958686 | 10/2007 |
| CN | 100348970 | 11/2007 |
| CN | 102997052 | 3/2013 |
| CN | 103106764 | 5/2013 |
| CN | 103497804 | 1/2014 |
| CN | 102997061 | 5/2015 |
| CN | 204824775 | 12/2015 |
| CN | 205640252 | 10/2016 |
| CN | 106764463 | 1/2019 |
| CN | 110513604 | 11/2019 |
| CN | 210176958 | 3/2020 |
| CN | 111537157 | 8/2020 |
| CN | 114001278 | 2/2022 |
| CN | 114877263 | 4/2023 |
| EP | 2602609 | 6/2013 |
| EP | 3076461 | 10/2016 |
| EP | 3101411 | 12/2016 |
| EP | 3112011 | 1/2017 |
| EP | 2994626 | 1/2018 |
| EP | 3285759 | 2/2018 |
| ES | 2398302 | 3/2013 |
| FR | 2388762 | 11/1978 |
| FR | 2689241 | 10/1993 |
| GB | 1179978 | 2/1970 |
| GB | 2097687 | 11/1982 |
| GB | 2545207 | 6/2017 |
| GB | 2559149 | 4/2022 |
| IN | 202141001384 | 1/2021 |
| IT | 201900008235 | 12/2020 |
| JP | 2004125039 | 4/2004 |
| JP | 2007204023 | 8/2007 |
| JP | 2008097832 | 4/2008 |
| JP | 2012002159 | 11/2014 |
| JP | 2016078893 | 5/2016 |
| KR | 20110010316 | 2/2011 |
| KR | 20130038986 | 4/2013 |
| KR | 102129951 | 7/2020 |
| KR | 102169280 | 10/2020 |
| KR | 102281640 | 7/2021 |
| RU | 2760879 | 12/2021 |
| WO | 1996006685 | 5/1996 |
| WO | 1997006004 | 2/1997 |
| WO | 1997006298 | 2/1997 |
| WO | 1998003711 | 1/1998 |
| WO | 2000063108 | 10/2000 |

(56) References Cited

FOREIGN PATENT DOCUMENTS

| | | |
|---|---|---|
| WO | 2002030551 | 4/2002 |
| WO | 2003003002 | 1/2003 |
| WO | 2003066423 | 8/2003 |
| WO | 2004003293 | 1/2004 |
| WO | 2004092307 | 10/2004 |
| WO | 2005018300 | 3/2005 |
| WO | 2007107652 | 9/2007 |
| WO | 2007112335 | 10/2007 |
| WO | 2007149851 | 12/2007 |
| WO | 2009013544 | 1/2009 |
| WO | 2009055024 | 4/2009 |
| WO | 2010042704 | 4/2010 |
| WO | 2010103260 | 9/2010 |
| WO | 2013112274 | 8/2013 |
| WO | 2014089443 | 6/2014 |
| WO | 2014173672 | 10/2014 |
| WO | 2015061868 | 5/2015 |
| WO | 2015153607 | 10/2015 |
| WO | 2016004107 | 1/2016 |
| WO | 2016026043 | 2/2016 |
| WO | 2016146404 | 9/2016 |
| WO | 2017074985 | 5/2017 |
| WO | 2017083778 | 5/2017 |
| WO | 2017087731 | 5/2017 |
| WO | 2017152269 | 9/2017 |
| WO | 2018005141 | 1/2018 |
| WO | 2018102378 | 6/2018 |
| WO | 2020044026 | 3/2020 |
| WO | 2020118020 | 6/2020 |
| WO | 2020132632 | 6/2020 |
| WO | 2020223803 | 11/2020 |
| WO | 2020237112 | 11/2020 |
| WO | 2021062563 | 4/2021 |
| WO | 2021100054 | 5/2021 |
| WO | 2022043197 | 3/2022 |
| WO | 2022126092 | 6/2022 |
| WO | 2022149501 | 7/2022 |
| WO | 2023287276 | 1/2023 |
| WO | 2023038579 | 3/2023 |
| WO | 2023137304 | 7/2023 |
| WO | 2023164683 | 8/2023 |
| ZA | 9606765 | 2/1998 |
| ZA | 200610366 | 1/2008 |

OTHER PUBLICATIONS

Membrane Technology and Research, Inc., Gasoline Vapor Recovery, 2018.

Jordan Technologies, Aereon, Recovering More Vapor = Increased Profits, 2015.

EPFL, Capturing CO2 from trucks and reducing their emissions by 90%, Dec. 23, 2019.

Sharma, Shivom et al., Carbon Dioxide Capture from Internal Combustion Engine Exhaust Using Temperature Swing Adsorption, Front. Energy Res., Sec. Carbon Capture, Utilization and Storage, Dec. 16, 2019.

Information Disclosure Declaration by Kyle E. Miller, Dec. 18, 2020.

Cott Manufacturing Company, FinkLet®/FinkPlate® Cathodic Proection Test Stations, Wayback Machine, May 22, 2000.

Lloyd's Register, Using technology to trace the carbon intensity of sustainable marine fuels, Feb. 15, 2023.

Alexandrakis et al.,"Marine Transportation for Carbon Capture and Sequestration (CCS)", Department of Civil and Environmental Engineering, Thesis, Massachusetts Institute of Technology, Jun. 2010.

Datta et al., "Advancing carbon management through the global commoditization of CO2: the case for dual-use LNG-CO2 shipping", Carbon Management, 2020, vol. 11, No. 6, 611-630.

Ibitoye et al., "Poster Abstract: A Convolutional Neural Network Based Solution for Pipeline Leak Detection", School of Information Technology, Carleton University, Ottawa, Canada, Nov. 2019.

IntelliView, "Thermal Imaging Provides Early Leak Detection in Oil and Gas Pipelines", Petro Industry News, www.Petro-Online.com, Aug./Sep. 2018.

Southwest Research Institute, "Methane Leak Detection", 2021.

Masterduct, "Case Studies: High temp marine grade ship engine exhaust fume hose", retrieved at https://www.masterduct.com/CaseStudies/Hightempshipengineexhaustfumehose.aspx.

ACTI, "Advanced Maritime Emissions Control System (AMECS)", retrieved at https://sustainableworldports.org/wp-content/uploads/presentation-on-AMECS.pdf.

Neutrik XXR-2 XX Series, https://www.parts-express.com/Neutrik-XXR-2-XX-Series-Color-Coding_Ring-Red, 2022.

Hou, Qingmin, An FBG Strain Sensor-Based NPW Method for Natural Gas Pipeline Leakage Detection, Hindawi, Mathematical Problems in Engineering, vol. 2021, Article ID 5548503, pp. 1-8.

* cited by examiner

EXHAUST HANDLING SYSTEMS FOR MARINE VESSELS AND RELATED METHODS

CROSS-REFERENCE TO RELATED APPLICATIONS

This application claims the benefit of U.S. provisional application Ser. No. 63/485,886, filed Feb. 18, 2023, and entitled "Exhaust Handling Systems for Marine Vessels and Related Methods," and U.S. provisional application Ser. No. 63/488,574, filed Mar. 6, 2023, and entitled "Exhaust Handling Systems for Marine Vessels and Related Methods," the contents of which are incorporated herein by reference in their entirety.

BACKGROUND

This disclosure generally relates to marine vessels that travel on navigable bodies of water. More particularly, this disclosure relates to exhaust handling systems for marine vessels and related methods.

A marine vessel may include any suitable vessel or boat that is transportable or movable across a navigable body of water (such as an ocean, lake, river, etc.). Such marine vessels may include engines, motors, generators, and other systems configured to output exhaust fluids (or more simply "exhaust"). Typically, the exhaust is emitted to the atmosphere during operations. However, when multiple marine vessels are concentrated in the same geographical area, the combined exhaust from the marine vessels may significantly degrade the local air quality. Berthing locations such as ports, piers, harbors, moorings, etc., may represent locations where large numbers of marine vessels congregate. Thus, in a number of jurisdictions, rules or regulations regarding the output of exhaust at berthing locations have been or will be implemented to preserve the air quality both within the berthing location and in neighboring areas.

BRIEF SUMMARY

Some embodiments disclosed herein include exhaust handling systems for a marine vessel that are configured to allow selective collection of exhaust output from the exhaust-emitting systems of the marine vessel while at a berthing location. In some embodiments, the collected exhaust may be routed to an exhaust cleaning assembly that may store and/or process the exhaust to prevent harmful chemicals or pollutants within the exhaust from being emitted to the atmosphere. In some embodiments, the exhaust handling systems of the embodiments disclosed herein may include a cap that is connected to an upper end portion of an exhaust stack of the marine vessel so as to form an enclosure around one or more (such as a plurality of) exhaust pipes. The collected exhaust may be emitted directly to the atmosphere when the marine vessel is not at a berthing location (or during a situation that requires venting of exhaust to the atmosphere) or may be selectively routed to an exhaust cleaning assembly to avoid such atmospheric venting when the marine vessel is berthed. Accordingly, through use of the embodiments disclosed herein, the exhaust-emitting systems of a marine vessel may continue to operate when the marine vessel is berthed while preventing (or restricting) the emission of exhaust (or at least the harmful and/or polluting components thereof) to the atmosphere.

Some embodiments disclosed herein are directed to exhaust handling system for a marine vessel. In some embodiments, the exhaust handling system includes a cap connected to a top end portion of an exhaust stack of the marine vessel so as to form an enclosure that at least partially surrounds an outlet of an exhaust pipe extending through the exhaust stack. In addition, the exhaust handling system includes a collection pipe in fluid communication with the cap such that the collection pipe is configured to receive exhaust from the enclosure. Further, the exhaust handling system includes a coupling connected to the collection pipe that is configured to connect to an exhaust cleaning assembly. The exhaust cleaning system includes at least one tank to receive the exhaust. The cap at least partially defines a first flow path for the exhaust to flow from the enclosure to an atmosphere surrounding the cap. The collection pipe at least partially defines a second flow path for the exhaust to flow from the enclosure to the coupling via the collection pipe.

In some embodiments, the exhaust handling system includes a cap connected to a top end portion of an exhaust stack of the marine vessel so as to form an enclosure that at least partially surrounds an outlet of an exhaust pipe extending through the exhaust stack. In addition, the exhaust handling system includes a vent in fluid communication with the enclosure, the vent including at least one valve member that is actuatable between a first position to emit exhaust from the enclosure to an atmosphere surrounding the cap via the vent and a second position to prevent an emission of exhaust from the enclosure to the atmosphere via the vent. Further, the exhaust handling system includes a collection pipe in fluid communication with the enclosure, and a coupling connected to the collection pipe and configured to connect to an exhaust cleaning assembly that includes at least one tank to receive the exhaust.

Some embodiments disclosed herein are directed to exhaust handling system for a marine vessel. In some embodiments, the exhaust handling system includes a cap connected to a top end portion of an exhaust stack of the marine vessel such that the cap is supported by the exhaust stack and such that the cap forms an enclosure that at least partially surrounds an outlet of an exhaust pipes extending through the exhaust stack. In addition, the exhaust handling system includes a pressure-actuated vent in fluid communication with the enclosure. Further, the exhaust handling system includes a collection pipe in fluid communication with the enclosure and configured to connect to an exhaust cleaning assembly that includes at least one tank to receive the exhaust.

Some embodiments are directed to methods. In some embodiment, the method includes (a) positioning a marine vessel in a berthing location, the marine vessel including a deck, an exhaust stack having an top end portion positioned above from the deck, an exhaust pipe extending through the exhaust stack to an outlet that is positioned above the top end portion of the exhaust stack, a cap connected to the exhaust stack so as to form an enclosure that at least partially surrounds the outlet of the exhaust pipe, and an collection pipe in fluid communication with the enclosure. In addition, the method includes (b) connecting an exhaust cleaning assembly to the collection pipe after (a), the exhaust cleaning assembly including at least one tank to receive the exhaust. Further, the method includes (c) operating the marine vessel to flow an exhaust emitted from the outlet of the exhaust pipe to the exhaust cleaning assembly after (b) via the collection pipe.

In some embodiments, the method includes (a) positioning a marine vessel in a berthing location, the marine vessel including an exhaust stack, an exhaust pipe extending through the exhaust stack to an outlet that is positioned above a top end portion of the exhaust stack, a cap that is connected to the exhaust stack to form an enclosure that surrounds the outlet of the exhaust pipe. In addition, the method includes (b) flowing an exhaust from the enclosure to an atmosphere surrounding the cap via a first flow path during (a), the first flow path at least partially defined by the cap. Further, the method includes (c) connecting an exhaust cleaning assembly positioned at the berthing location to the cap after (a), the exhaust cleaning system including at least one tank to receive the exhaust. Still further, the method includes (d) flowing the exhaust from the enclosure to the exhaust cleaning assembly via a second flow path after (b), the second flow path at least partially defined by the cap.

Embodiments described herein include a combination of features and characteristics intended to address various shortcomings associated with certain prior devices, systems, and methods. The foregoing has outlined rather broadly the features and technical characteristics of some of the disclosed embodiments in order that the detailed description that follows may be better understood. The various characteristics and features described above, as well as others, will be readily apparent to those having ordinary skill in the art upon reading the following detailed description, and by referring to the accompanying drawings. It should be appreciated that this disclosure may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various embodiments, reference will now be made to the accompanying drawings in which.

DETAILED DESCRIPTION

As previously described, the exhaust from marine vessels at a berthing location may degrade air quality and may even be restricted by local rules and regulations. However, ceasing operation of all exhaust-emitting systems on a marine vessel may not be desirable or feasible while the marine vessel is at the berthing location. For instance, electrical generation systems (for example, diesel generators, turbine generators, etc.) may continue to operate so that other electrically operated systems and assemblies of the marine vessel (for example, communications systems, safety systems, control systems, water and sewage systems, HVAC systems, etc.) may also be operated while at the berthing location. In addition, some berthing locations do not have sufficient infrastructure to support and operate these various systems and assemblies of the berthed marine vessels independently of the onboard exhaust-emitting systems.

Accordingly, embodiments disclosed herein include exhaust handling systems for a marine vessel that are configured to allow selective collection of exhaust output from the exhaust-emitting systems of the marine vessel while at a berthing location. In some embodiments, the collected exhaust may be routed to an exhaust cleaning assembly that may store and/or process the exhaust to prevent harmful chemicals or pollutants within the exhaust from being emitted to the atmosphere. In some embodiments, the exhaust handling systems of the embodiments disclosed herein may include a cap that is fixed to an upper end of an exhaust stack of the marine vessel so as to form an enclosure around one or more (e.g., a plurality of) exhaust pipes. The collected exhaust may be emitted directly to the atmosphere when the marine vessel is not at a berthing location (or during a situation that requires venting of exhaust to the atmosphere) or may be selectively routed to an exhaust cleaning assembly to avoid such atmospheric venting when the marine vessel is berthed. Accordingly, through use of the embodiments disclosed herein, the exhaust-emitting systems of a marine vessel may continue to operate when the marine vessel is berthed while preventing (or restricting) the emission of exhaust (or at least the harmful and/or polluting components thereof) to the atmosphere.

Figure 1:
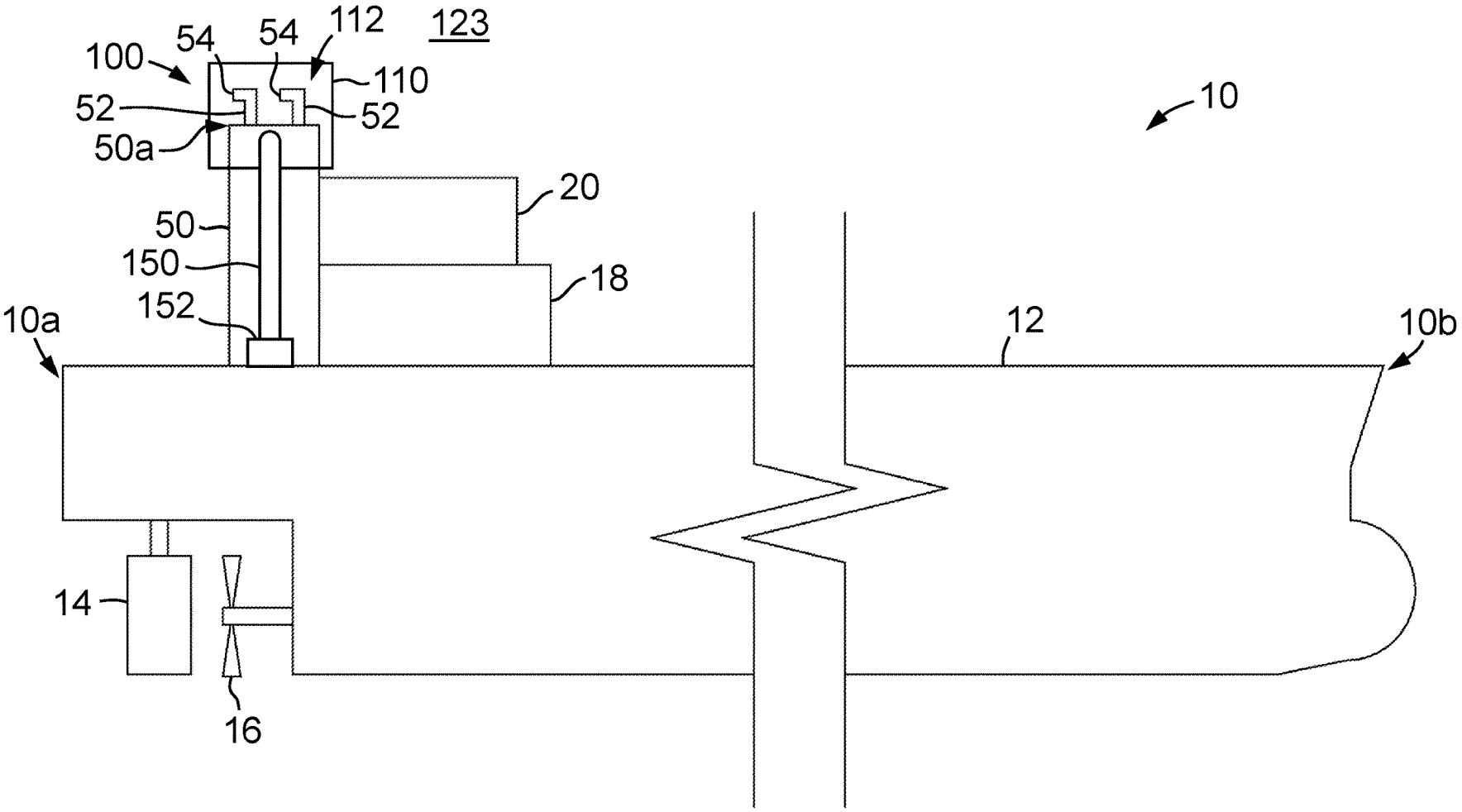
FIG. 1 is a schematic side view of a marine vessel having an exhaust handling system according to some embodiments of the disclosure.

Reference is now made to FIG. 1, which shows a marine vessel 10 and an exhaust handling system 100 according to some embodiments. The marine vessel 10 may include any suitable vessel or ship that may travel within or across a navigable body of water such as, for instance, an ocean, a sea, a lake, a river, a channel, etc. In some embodiments, the marine vessel 10 may be a cargo vessel, such as a container ship, tankship, reefer ship, etc.

Marine vessel 10 includes a rear end (or stern) 10*a*, a front end (or bow) 10*b* opposite rear end 10*a*, and a main deck (or more simply "deck") 12 extending between ends 10*a*, 10*b*. Deck 12 may define an exterior surface (or collection of exterior surfaces) on the marine vessel 10 that may be accessed by personnel.

A rudder 14 and propeller 16 may be positioned at (or proximate to) rear end 10*a*. As is known to one having ordinary skill in the art, the propeller 16 may provide propulsion to the marine vessel 10, and the rudder 14 may be turned to steer the marine vessel 10 within a body of water.

An accommodation deck (or more simply "accommodation") 18 is positioned atop deck 12. The accommodation 18 is the living space of the marine vessel 10 and may include one or more cabins (or rooms), galleys, store rooms, messrooms, or other rooms that may be used by personnel. A bridge 20 may be positioned atop (or adjacent to) the accommodation 18. The bridge 20 may include one or more controls for the marine vessel 10 including (for instance) steering controls, communications systems, other system controls, etc.

Figure 2:
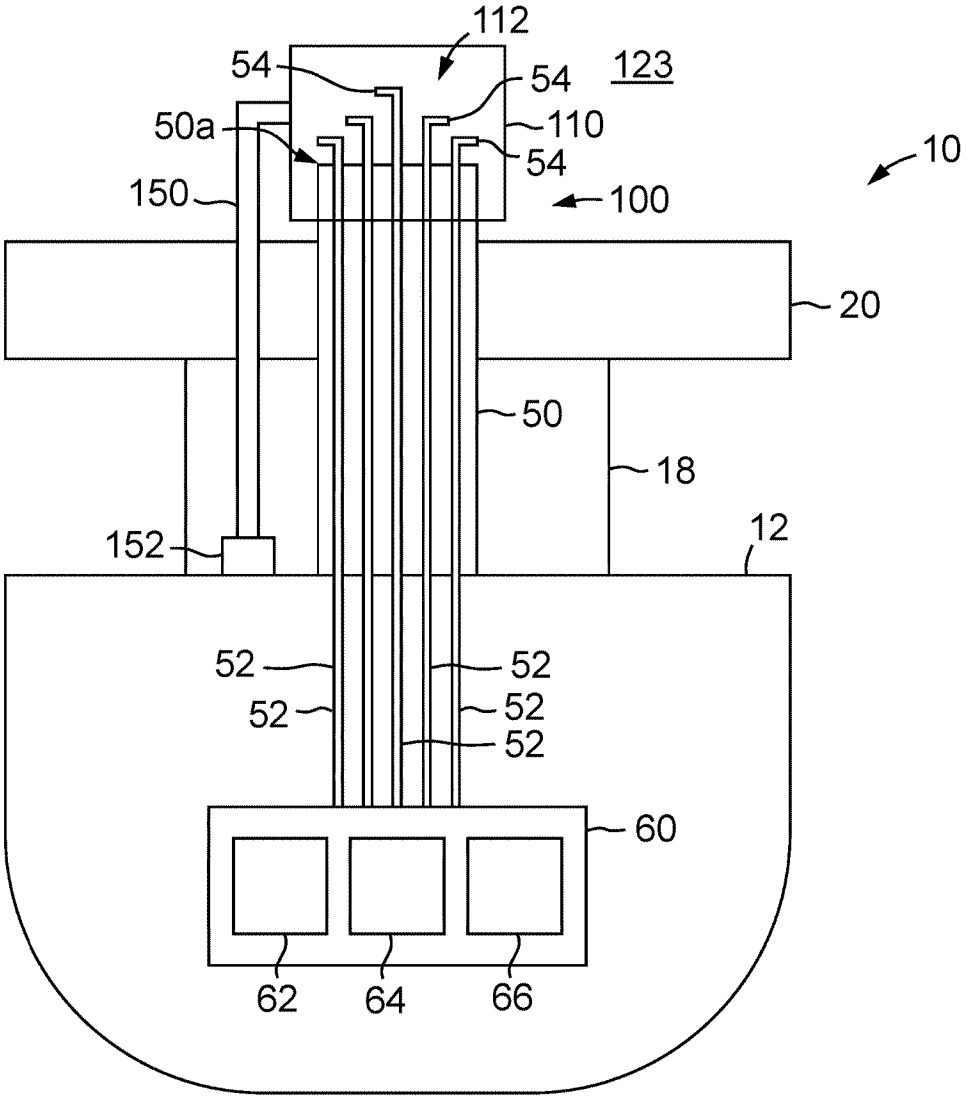
FIG. 2 is a schematic rear view of the marine vessel of FIG. 1 according to some embodiments of the disclosure.

As shown in FIGS. 1 and 2, an exhaust stack 50 may extend upward and away from deck 12. The exhaust stack 50 may sometimes be referred to as an "exhaust funnel." The exhaust stack 50 may be positioned adjacent the accommodation 18 and bridge 20 along deck 12. Specifically, the exhaust stack 50 may be positioned between bridge 20 and rear end 10*a* along deck 12 in some embodiments. Exhaust stack 50 may extend upward from deck 12 to a top end portion 50*a*. One or more (such as one or a plurality of) exhaust pipes 52 extend through exhaust stack 50 and out of the top end portion 50*a*. Specifically, each exhaust pipe 52 has an outlet 54 that is extended out of the exhaust stack 50 and positioned above the top end portion 50*a*.

During operations, each exhaust pipe 52 (or some of the exhaust pipes 52) may output exhaust fluid (or "exhaust"). Specifically, as shown in FIG. 2, each exhaust pipe 52 is fluidly connected to one or more exhaust-emitting systems 62, 64, 66 (collectively referred to as "exhaust-emitting systems 60"). For instance, the exhaust-emitting systems 60 of marine vessel 10 may include diesel electric generator(s) 62, boilers 64, inert gas systems 66, or other systems or assemblies that may output combustion (or other) exhaust during operations. Accordingly, marine vessel 10 includes an exhaust handling system 100 that is configured to selectively collect and route exhaust emitted from the exhaust pipes 52 to an exhaust cleaning assembly (not shown in FIG. 1 but see exhaust cleaning assembly 200 shown in FIGS. 7 and 8 and described herein).

As shown in FIGS. 1 and 2, exhaust cleaning assembly 100 includes a cap 110 that is connected to exhaust stack 50. Specifically, cap 110 may be connected to top end portion 50*a* of exhaust stack 50 so as to form or define an enclosure 112 that surrounds (or at least partially surrounds) the outlets 54 of each of the exhaust pipes 52. As will be described in more detail below, the enclosure 112 may collect exhaust emitted from the outlets 54 of exhaust pipes 52. A collection pipe 150 extends from cap 110 toward the deck 12 and is connected to the cap 110 such that the collection pipe 150 is in fluid communication with the enclosure 112. Thus, during operations, exhaust may be collected within enclosure 112 and routed toward deck 12 via collection pipe 150.

In some embodiments, the cap 110 may be connected to the exhaust stack 50 so that the outlets 54 of less than all of the exhaust pipes 52 are surrounded (at least partially) by the enclosure 112. Thus, in some embodiments, the outlets 54 of one or more of the exhaust pipes 52 may be positioned outside of the enclosure 112 and the outlets of one or more of the exhaust pipes 52 may be positioned inside the enclosure 112. For instance, without being limited to this or any other theory, outlet pipes 52 associated with the main engine of the marine vessel 10 may not normally emit exhaust (or may not emit a substantial volume of exhaust) when the marine vessel 10 is stationary at a berthing location. Thus, the outlet pipes 52 associated with the main engine of the marine vessel 10 may not be positioned in the enclosure 112 so as to minimize a size and complexity of the cap 10 as well as to avoid constriction of the exhaust flow out from the main engine of the marine vessel 10 when the marine vessel 10 is not at a berthing location. In some embodiments, multiple caps 110 may be attached to exhaust stack 50 (or to multiple exhaust stacks 50 depending on the configuration of the marine vessel 10) so that different caps 110 may surrounding (at least partially) different ones or groups of the exhaust pipes 52 during operations. For instance, in some embodiments, a first cap 110 may be positioned on a first exhaust stack 50 so as to surround (at least partially) one or more exhaust pipes 52 extending therethrough, and a second cap 110 may be positioned on a second exhaust stack 50 so as to surround (at least partially) one or more exhaust pipes 52 extending therethrough.

Collection pipe 150 (or a portion of collection pipe 150) may include a rigid pipe that is rigidly connected (such as via brackets, welding, bolting, riveting, etc.) to cap 110 and marine vessel 10 (FIGS. 1 and 2). In some embodiments, the collection pipe 150 (or a portion of the collection pipe 150) may include flexible ductwork (or ducting) such as, for instance, flexible hoses and the like that may be readily deformed and maneuvered during operations. In some embodiments, the collection pipe 150 may be temporarily connected to the cap 110 and/or the marine vessel 10 so as to allow collection pipe 150 to be easily removed when not in use (such as when marine vessel 10 is not at a berthing location). In addition, in some embodiments, the collection pipe 150 (whether it includes rigid pipe and/or flexible ductwork) may include one or more layers of thermal insulation.

Collection pipe 150 may include or be connected to a coupling 152 that, as will be described in more detail below, may be connected to an exhaust cleaning assembly during operations. The coupling 152 may be positioned at or proximate to the deck 12 such that the coupling 152 may be accessible from the deck 12. Thus, during operations, personnel may interact with the coupling 152 (for example, to connect the coupling 152 and collection pipe 150 to an exhaust cleaning assembly) from the deck 12. Further details of the exhaust handling system 100 are now described below according to some embodiments.

Figure 3:
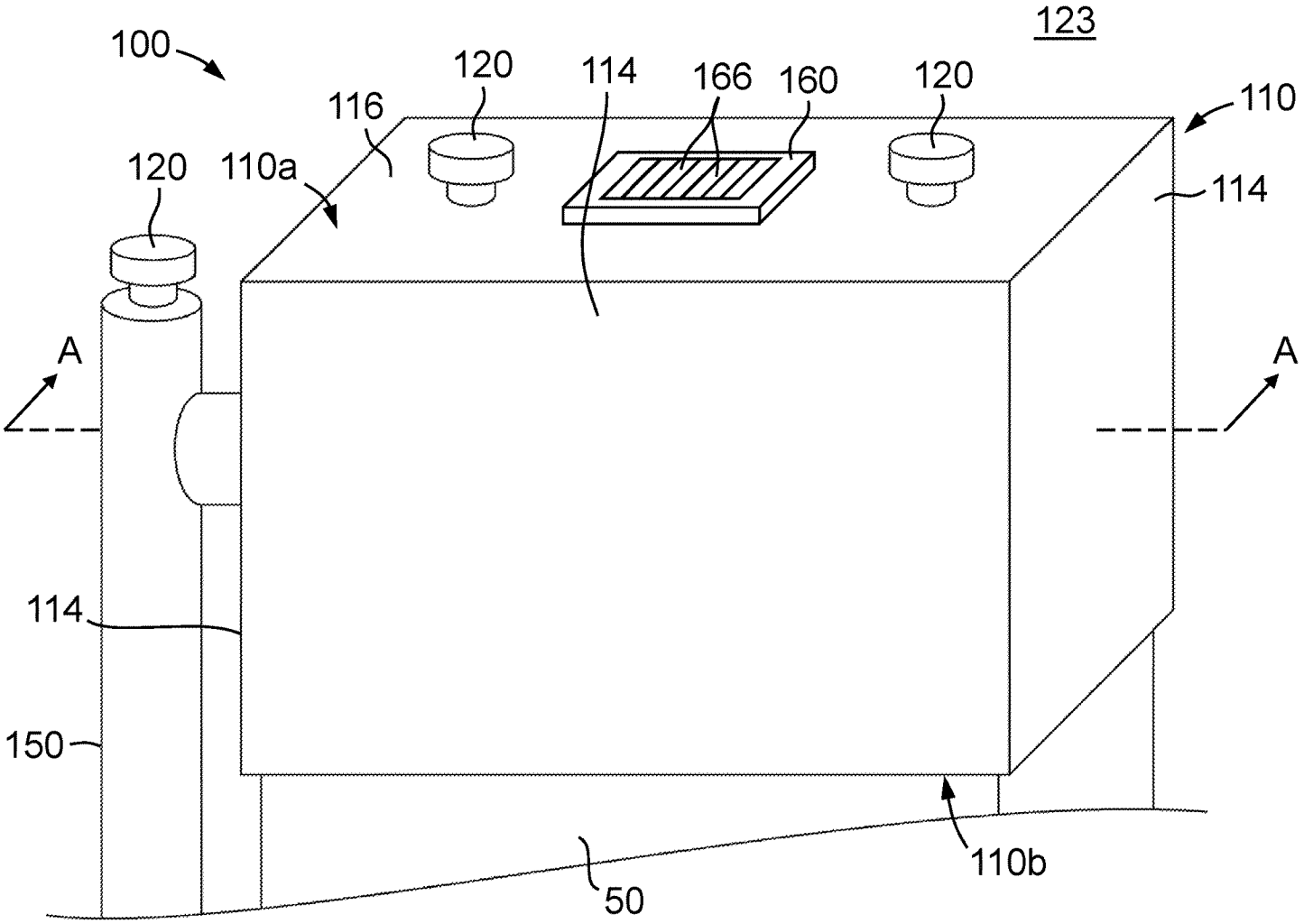
FIG. 3 is a perspective view of a cap of the exhaust handling system of the marine vessel of FIG. 1 according some embodiments of the disclosure.
Figure 4:
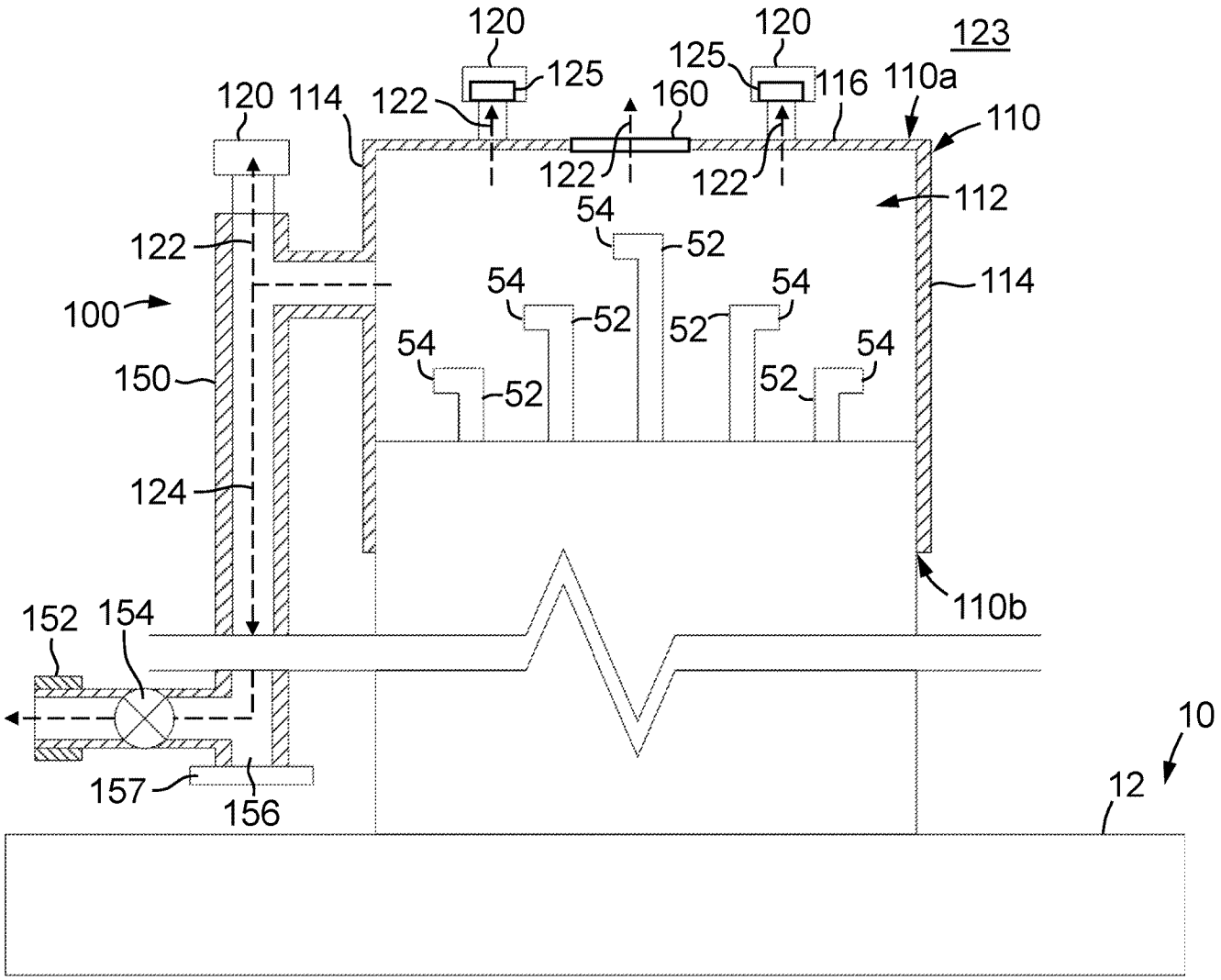
FIG. 4 is a cross-sectional view taken along section A-A in FIG. 3 according to some embodiments of the disclosure.

As shown in FIGS. 3 and 4, in some embodiments the cap 110 may include an upper closed end 110*a* (or more simply "upper end 110*a*") and a lower open end 110*b* (or more simply "lower end 110*b*") opposite the upper end 110*a*. In some embodiments, the cap 110 may be shaped as a rectangular parallelepiped, such that the cap 110 includes a planar top 116 and a plurality of (e.g., four) planar sides 114 extending from planar top 116 to lower end 110*b*. However, other shapes are contemplated for cap 110, such as, for instance, cylindrical, conical, triangular prism, irregular shape, etc. As best shown in FIG. 4, the top 116 and sides 114 define the enclosure 112. During operations, cap 110 may be connected to top end portion 50*a* of exhaust stack 50 such that the enclosure 112 surrounds the outlets 54 of the exhaust pipes 52 as previously described. In addition, the collection pipe 150 may be fluidly connected to the enclosure 112 on one of the planar sides 114.

A plurality of flow paths are defined within exhaust handling system 100 to route exhaust out of the enclosure 112 of cap 110 during operation. For instance, as shown in FIG. 4, one or more first flow paths 122 may allow exhaust to flow from the enclosure 112 to the atmosphere 123 surrounding the cap 110. For instance, the first flow path(s) 122 may extend out of the enclosure 112 and through one or more vents 120, 160 to the surrounding atmosphere 123. Thus, the first flow path(s) 122 may be at least partially defined by the cap 110 and one or more of the vents 120, 160.

The vents 120 are connected to the cap 110 such that they are in fluid communication with the enclosure 112. The vents 120 may include an actuatable vent. For example, in some embodiments, the vents 120 may have a valve or valve member 125 (such as a gate valve, flapper valve, butterfly valve, etc.) that is actuatable between an open position and a closed position. When the valve member 125 of a vent 120 is in the open position, the vent 120 may allow exhaust to flow therethrough and into the surrounding atmosphere 123, and when the valve member 125 of a vent 120 is in the closed position, the vent 120 may prevent (or restrict) the flow of exhaust therethrough to the surrounding atmosphere 123. In some embodiments, the valve members 125 of vents 120 may be actuated between the open and closed positions by a controller (such as controller 300 shown in FIG. 12 and described herein) and/or manually by personnel. In some embodiments, the vents 120 (more specifically the valve members 125) may be pressure actuated (such that the vents 120 may be "pressure-actuated vents"). Specifically, in some embodiments, the valve member 125 of one or more of the vents 120 may biased such that the valve member 125 is configured to open when a sufficient differential pressure is applied across the vent 120 (and against the bias applied to the valve member 125). For instance, in some embodiments, the valve member(s) 125 of one or more of the vents 120 may be biased to the closed position (for example, via a spring or other suitable biasing member or assembly), and when a pressure within the enclosure 112 rises above a threshold, the valve member(s) 125 of the one or more of the vents 120 may transition from the closed position to the open position to allow exhaust to flow out of the enclosure 112 to the surrounding atmosphere 123.

Figure 5:
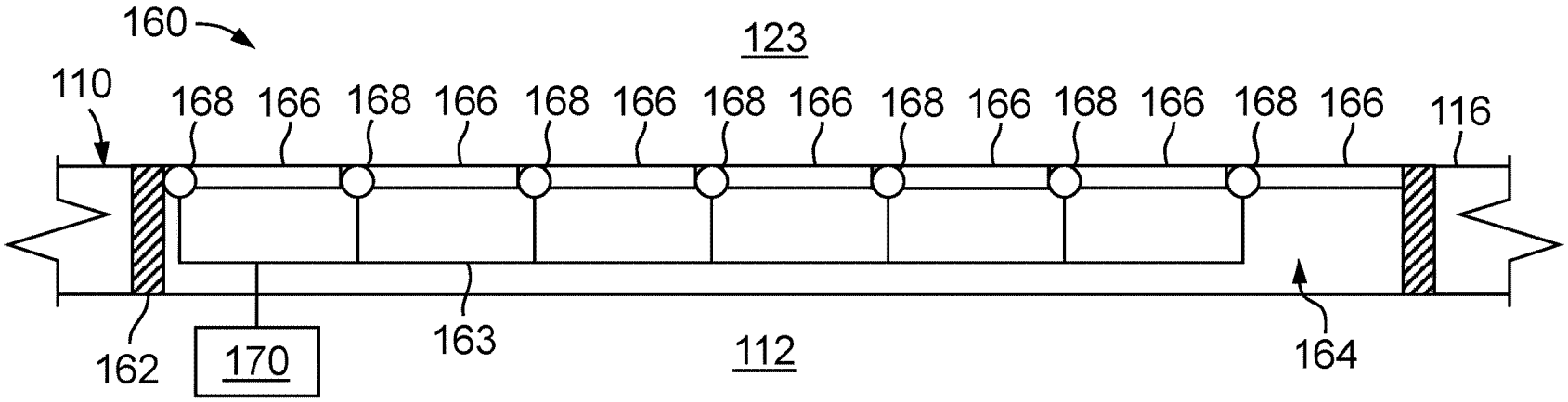
FIGS. 5 and 6 are side, cross-sectional views of a vent for a cap of the exhaust handling system of FIG. 3 according to some embodiments of the disclosure.

The vent 160 may be connected to cap 110 such that vent 160 is in fluid communication with the enclosure. The vent 160 may be positioned along the planar top 116 of cap 110 and may be also be configured to transition between a closed position and an open position to selectively prevent and allow exhaust to flow out of enclosure 112 to the surrounding atmosphere 123, respectively. As shown in FIG. 5, in some embodiments, the vent 160 may include a housing 162 that defines an opening or flow path 164 therethrough. The housing 162 is mounted to the planar top 116 so that the opening 164 forms or defines an opening in the planar top 116 of cap 110. A plurality of louvers 166 are pivotably connected to the housing 162 such that the louvers 166 are parallel to one another and span across the opening 164. Each louver 166 is pivotably connected to the housing 162 via a corresponding hinge 168 so that the louvers 166 may pivot about the hinge 168, relative to the housing 162 during operations. Specifically, the louvers 166 may be pivoted about the hinges 168 between a first or closed position shown in FIG. 5 and a second or open position shown in FIG. 6 (as well as a plurality of positions between the closed position of FIG. 5 and the open position of FIG. 6). Thus, the vent 160 may be referred to herein as an "actuatable vent" similar to embodiments of the vent 120 previously described, and the louvers 166 may be referred to as actuatable "valve members" or "valves" similar to embodiments of the valve members 125 of vents 120 previously described.

When the louvers 166 are in the closed position (FIG. 5), the louvers 166 may engage, interlock, overlay, overlap, and/or otherwise cooperate with one another so as to cover and therefore occlude the opening 164. As a result, when the louvers 166 are in the closed position (FIG. 5), exhaust is prevented (or is at least restricted) from flowing out of the enclosure 112 to the surrounding atmosphere 123. In some embodiments, the louvers 166 may include or be connected to seals (such as compliant seals) that may further enhance the ability of louvers 166 to prevent (or at least restrict) the flow of exhaust out of the enclosure 112 via the opening 164 when louvers 166 are in the closed position (FIG. 5). Conversely, when the louvers 166 are in the opening position (FIG. 6), the louvers 166 may rotate or pivot about the hinges 168 so as to disengage with one another and thereby open or uncover the opening 164 of housing 162 and place the surrounding atmosphere 123 in fluid communication with the enclosure 112.

Figure 6:
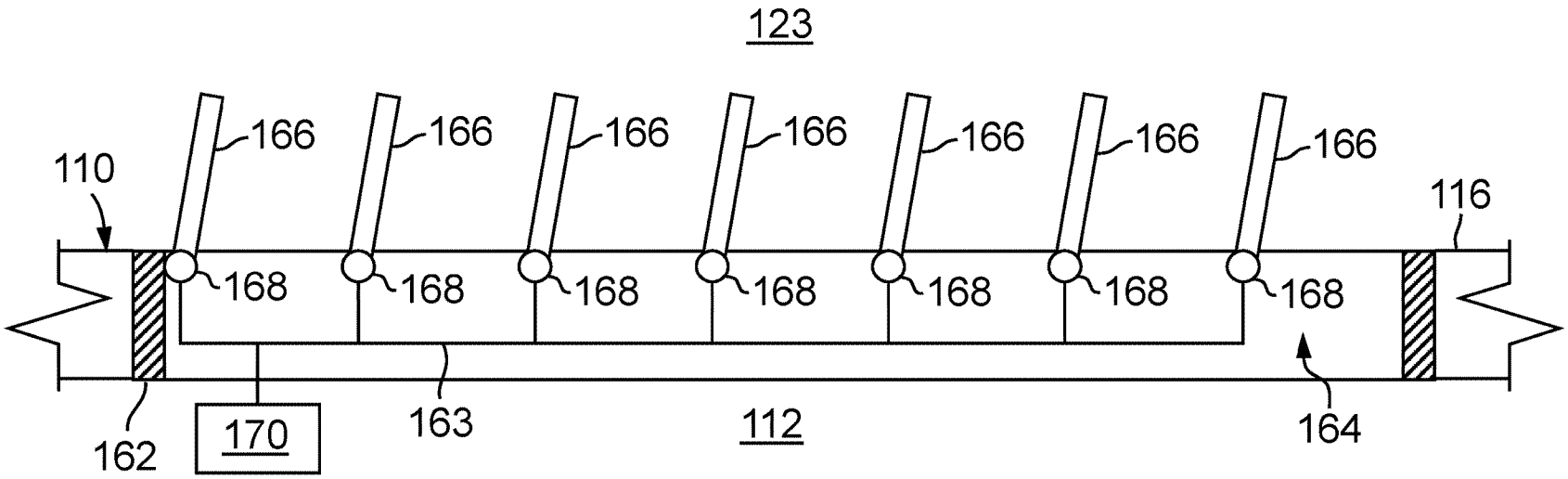

The louvers 166 may be synchronously rotated about the hinges 168 between the closed position (FIG. 5) and the open position (FIG. 6) by a suitable transmission or connection 163 (such as a connection bar, gears—such as rack and pinion gears, or other suitable connection device or assembly). A driver 170 may be connected to the louvers 166 (such as directly connected to louvers 166 or indirectly connected to louvers 166 via connection 163). In some embodiments, the driver 170 may include a suitable motor, such as, for instance, an electric motor, hydraulic motor, pneumatic motor, etc. In some embodiments, the driver 170 may include a manual driver such as a chain pull, lever, or other manually operated device. During operations, the driver 170 may actuate the louvers 166 (such as via the connection 163) to rotate or transition between the closed position (FIG. 5) and the closed position (FIG. 6) to selectively prevent (or restrict) or allow, respectively, exhaust to flow out of the enclosure 112 to the surrounding atmosphere 123. In some embodiments, the vent 160 may also include a fan or blower that may draw exhaust out of the enclosure 112 and through the opening 164 and into the atmosphere 123 when the louvers 166 are in the open position (FIG. 6). Still further, in some embodiments, the louvers 166 may be actuated between the open position and the closed position by a differential pressure applied across the vent 160 between the enclosure 112 and the atmosphere 123. For instance, the driver 170 may be connected to or may include a pressure sensor and may actuate the louvers 166 based on an output thereof. As another example, the louvers 166 may be rotationally biased (for example, via torsional springs or other biasing members or systems) toward the closed position (FIG. 5) and may transition to the open position (FIG. 6) in response to a sufficient differential pressure between the enclosure 112 and atmosphere 123. Thus, the vent 160 may also be referred to herein as a "pressure-actuated vent" as described herein.

As shown in FIG. 4, in some embodiments, first flow path(s) 122 may extend through one or more of the vents 120, 160 positioned on the planar top 116 of the cap 110. In some embodiments, the first flow path(s) 122 may extend through vent(s) 120 and/or vents 160 that are positioned along collection pipe 150. In some embodiments, a plurality of first flow paths 122 may extend out of the enclosure 112 via vents 120, 160 in the planar top 116 and/or the collection pipe 150; however, in some embodiments, a single first flow path 122 may extend out of the enclosure 112 via a vent 120 or a vent 160 in either the planar top 116 or the collection pipe 150. Still further, in some embodiments, a first flow path 122 may extend out of the enclosure 112 via a vent 120 and/or a vent 160 that is positioned along and/or coupled to one of the planar sides 114 of cap 110.

As shown in FIG. 4, one or more second flow paths 124 may allow exhaust to flow out of the enclosure 112 via the collection pipe 150. Thus, the one or more second flow paths 124 may be at least partially defined by the cap 110 and the collection pipe 150. As previously described, the collection pipe 150 may extend from the cap 110 to the coupling 152 (that may be accessible from the deck 12 of marine vessel 10 as previously described). In particular, the coupling 152 may include any suitable coupling mechanism that is configured to connect the collection pipe 150 to an exhaust cleaning assembly (such as the exhaust cleaning assembly 200 shown in FIGS. 7 and 8) via a suitable conduit (for example, a hose, pipe, tubing, etc.). For instance, in some embodiments, the coupling 152 may include a flanged coupling, quick connect coupling, threaded coupling, union, clamped coupling, or some combination thereof. A valve 154 is positioned along the collection pipe 150 between the enclosure 112 and the coupling 152. The valve 154 may be actuated between an open position to allow exhaust to flow along collection pipe 150 via second flow path 124 to coupling 152, and a closed position to prevent (or at least restrict) the flow of exhaust along the collection pipe 150 via second flow path 124 to coupling 152. In some embodiments, the valve 154 may be actuated between the open and closed positions by a controller (such as the controller 300 shown in FIG. 12) and/or manually by personnel.

A cleanout port 156 may be positioned along the collection pipe 150 between the coupling 152 and the enclosure 112. Specifically, the cleanout port 156 may be positioned along collection pipe 150 so that it is accessible from the deck 12 of marine vessel 10. The cleanout port 156 is configured to provide access into the collection pipe 150 independent of the coupling 152 so that personnel may clean out or remove debris that may collect within the collection pipe 150 during operations and thereby prevent the second flow path 124 (or one or more of the first flow paths 122) from becoming obstructed. In some embodiments, the clean out port 156 may be closed or occluded via a flanged cap 157; however, any suitable caping or closing device (such as a hatch, blind, etc.) may be utilized to close the cleanout port 156 in some embodiments.

In some embodiments, the cap 110 may be permanently or fixedly installed on the marine vessel 10. Specifically, the cap 110 may remain connected and fixed to the exhaust stack 50 both when the marine vessel is at berth (such as at a berthing location) and when the marine vessel 10 is not at a berthing location and is moving across a body of water (for example, across an ocean or lake). Thus, the cap 110 may remain fixed to the exhaust stack 50 so that the cap 110 may not be readily lifted or removed from the exhaust 50 without breaking or disconnecting the connections between the cap 110 and exhaust stack 50. In some embodiments, the cap 110 may be welded to the exhaust stack 50. In some embodiments, the cap 110 may be integrally formed as part of the exhaust stack 50 itself. In some embodiments, the cap 110 may be fixed to the exhaust stack 50 via one or more of a bolted connection, a rivetted connection, or other suitable connections or structures.

In some embodiments, the cap 110 may be temporarily connected to the exhaust stack 50 such that the cap 110 may be installed on the exhaust stack 50 when the marine vessel 10 is positioned at a berthing location and then may be removed when the marine vessel 10 is to move out of (or away from) the berthing location. In some embodiments, the cap 110 may be temporarily installed on the exhaust stack 50 via clamps, a shouldered engagement (such as by resting the cap 110 on an external shelf or shoulder of the exhaust stack 50), and/or any other suitable temporary connection.

Regardless as to whether the cap 110 is permanently or temporarily connected to the exhaust stack 50, in some embodiments, the cap 110 may be supported (such as fully supported) by the exhaust stack 50. That is, the weight of the cap 110 may be borne by the exhaust stack 50 (or other frames, structures, or other components of the marine vessel 10) during operations so that a crane or other lifting device may not be attached to the cap 110 during operations. A crane (or other lifting device) may be utilized to lower the cap 110 onto exhaust stack 50 or lift the cap 110 away from the exhaust stack 50; however, once the cap 110 is connected to the exhaust stack 50, the crane (or other lifting device) may be disconnected from cap 110 and the weight of the cap 110 may be borne by the exhaust stack 50 and/or other portions or components of the marine vessel 10.

The flow paths 122, 124 may selectively route exhaust out of the enclosure 112 when the marine vessel 10 is and is not at berth. For instance, during operations, when the marine vessel 10 is not at berth (such as when marine vessel 10 is moving across or within a body of water), exhaust emitted from the outlets 54 of exhaust pipes 52 may flow into the enclosure 112 and then is emitted from the enclosure 112 via the one or more first flow paths 122. Specifically, when the marine vessel 10 is not at berth, the valve 154 positioned along the collection pipe 150 may be transitioned to the closed position to prevent exhaust from flowing out of enclosure 112 and toward the deck 12 via the coupling 152. As a result, the exhaust emitted from the outlets 54 of exhaust pipes 52 may flow out of the enclosure 112 to the surrounding atmosphere 123 via the vent(s) 120 and/or the vent(s) 160 along the first flow path(s) 122. As previously described, the vents 120, 160 may be actuated (e.g., via controller, personnel, etc.) to the open position to allow the exhaust to flow out of the enclosure 112 to the surrounding atmosphere 123. Alternatively, for embodiments in which the vents 120, 160 are pressure-actuated as previously described, the emission of the exhaust from the outlets 54 of exhaust pipes 52 into enclosure 112 increases the pressure within the enclosure 112 (e.g., such as when the valve 154 is closed) until one or more of the vent(s) 120, 160 are transitioned to the open position to vent the exhaust to the surrounding atmosphere 123 along the first flow path(s) 122.

Figure 7:
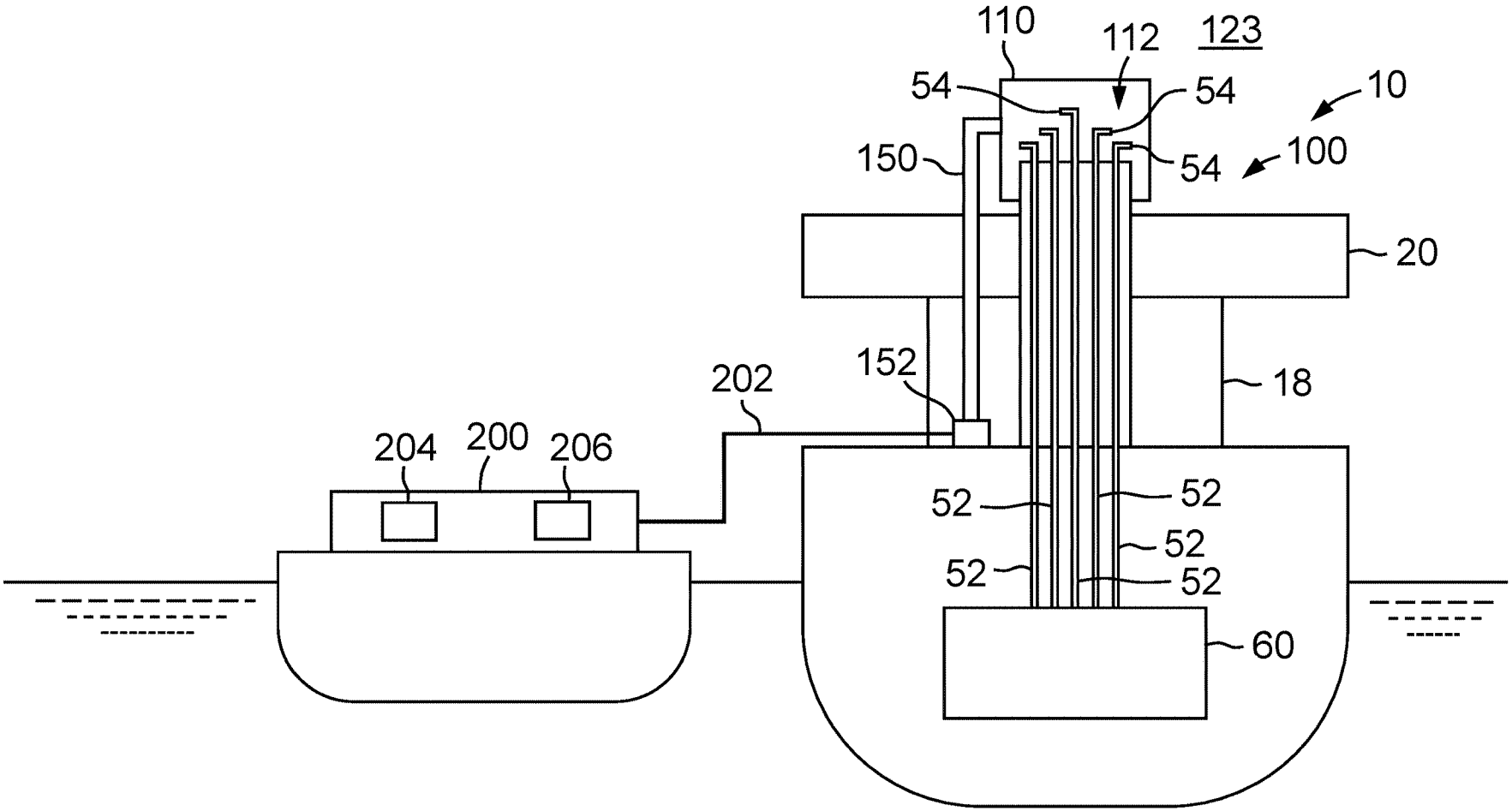
FIG. 7 is a schematic view of the marine vessel of FIG. 1 connected to an exhaust cleaning assembly positioned on a barge according to some embodiments of the disclosure.

As shown in FIGS. 4 and 7, when the marine vessel 10 is at berth (for example, is moored or docked at a berthing location as previously described), the exhaust emitted into the enclosure 112 via the outlets 54 of exhaust pipes 52 may be flowed out of the enclosure 112 via the second flow path 124. Specifically, when the marine vessel 10 is at berth, an exhaust cleaning assembly 200 may be connected to the coupling 152 of the collection pipe 150 via a conduit 202, and valve 154 (FIG. 4) may be transitioned to the open position. As a result, exhaust emitted from outlets 54 of exhaust pipes 52 may be flowed out of the enclosure 112 to the exhaust cleaning assembly 200 via the second flow path 124 and conduit 202. As is known by one having ordinary skill in the art, within the exhaust cleaning assembly 200, the exhaust may be treated via one or more suitable processes or assemblies to remove some or all of the pollutants or other harmful constituents of the exhaust (e.g., nitrous oxide (NOx), carbon dioxide (CO2), carbon monoxide (CO), soot, etc.). In some embodiments, the exhaust cleaning assembly 200 may simply capture and store the exhaust such that the exhaust may then be transferred to a suitable cleaning process or other storage facility. Thus, in some embodiments, the exhaust cleaning assembly 200 may include one or more tanks (or other suitable vessels 204 that are configured to receive and store the exhaust (or some other fluid such as treated exhaust, treatment fluids, etc.). Additionally or alternatively, in some embodiments, the exhaust cleaning system 200 may include one or more reactors 206 such as catalyst reactors, that are configured to treat or clean the exhaust during operations.

Regardless of the particular makeup or function of the exhaust cleaning assembly 200 (such whether the exhaust cleaning assembly 200 is configured to treat or simply store exhaust during operations), the exhaust emitted from the outlets 54 of exhaust pipes 52 may be prevented from flowing (or mostly restricted from flowing) to the atmosphere 123 at the berthing location when coupling 152 is connected to exhaust cleaning assembly 200 via conduit 202. For instance, when the exhaust is flowing along the second flow path 124 to the exhaust cleaning assembly, the vent(s) 120, 160 may be actuated to the closed position (such as via a controller or personnel or by a differential pressure between the atmosphere 123 and enclosure112/collection pipe 150) to prevent a flow of exhaust along the first flow path(s) 122. As a result, the atmospheric conditions at the berthing location may be improved without having to shut down the exhaust-emitting systems 60 (FIG. 2) of the marine vessel 10.

Figure 8:
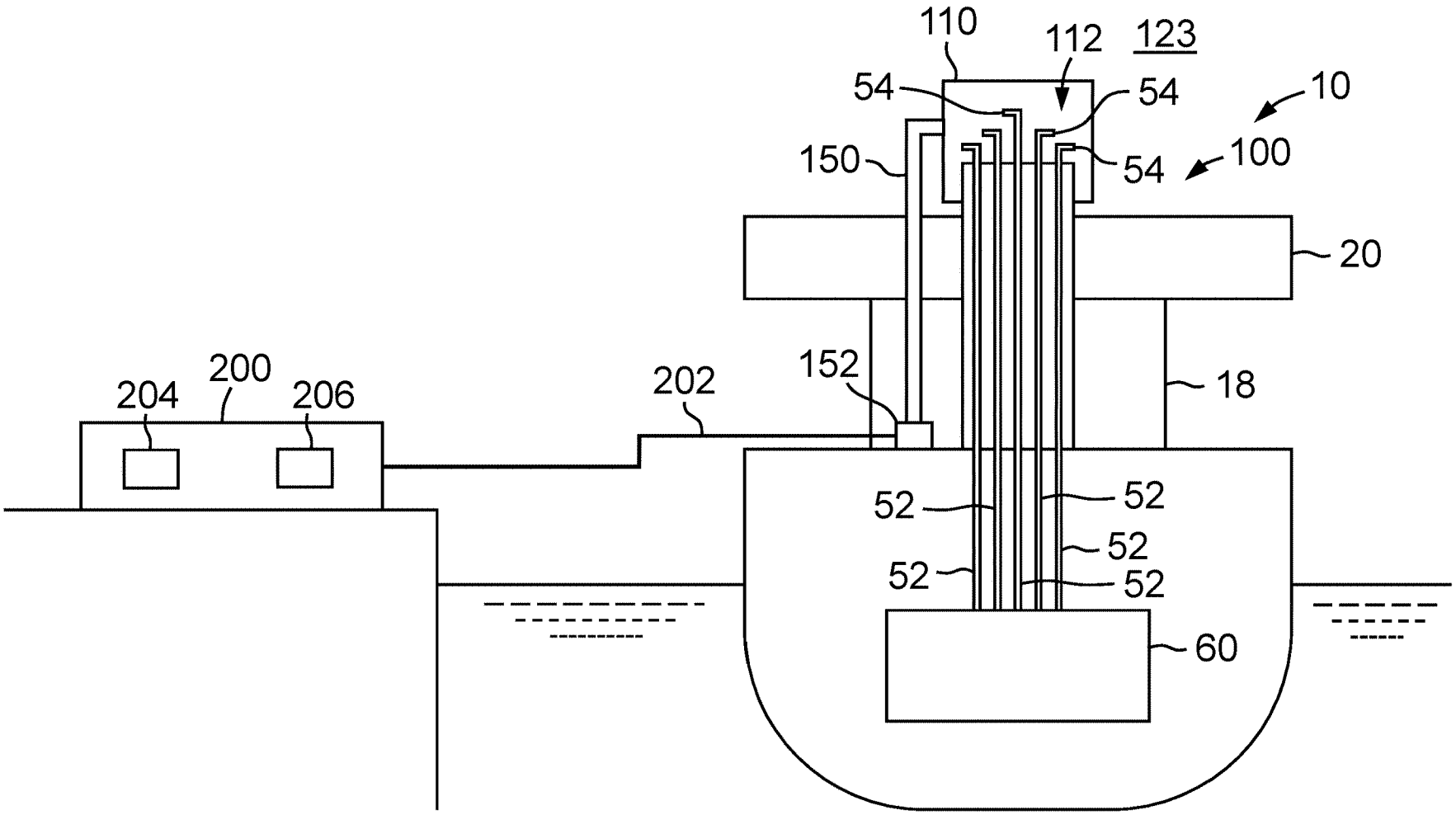
FIG. 8 is a schematic view of the marine vessel of FIG. 1 connected to an exhaust cleaning assembly positioned on-shore according to some embodiments of the disclosure.

As shown in FIG. 7, in some embodiments, the exhaust cleaning assembly 200 may be positioned on at barge or other marine vessel that is positioned proximate to (e.g., alongside) the marine vessel 10 while the marine vessel 10 is at the berthing location. As shown in FIG. 8, in some embodiments, the exhaust cleaning assembly 200 may be positioned onshore at the berthing location. In some embodiments, the exhaust cleaning assembly 200 (or a portion thereof) may be remote from the berthing location (e.g., one or more miles away from the berthing location) and the conduit 202 may include (or be connected to) a suitable pipeline or other suitable infrastructure to transport the exhaust from the berthing location to the remotely located exhaust cleaning assembly 200.

Figure 9:
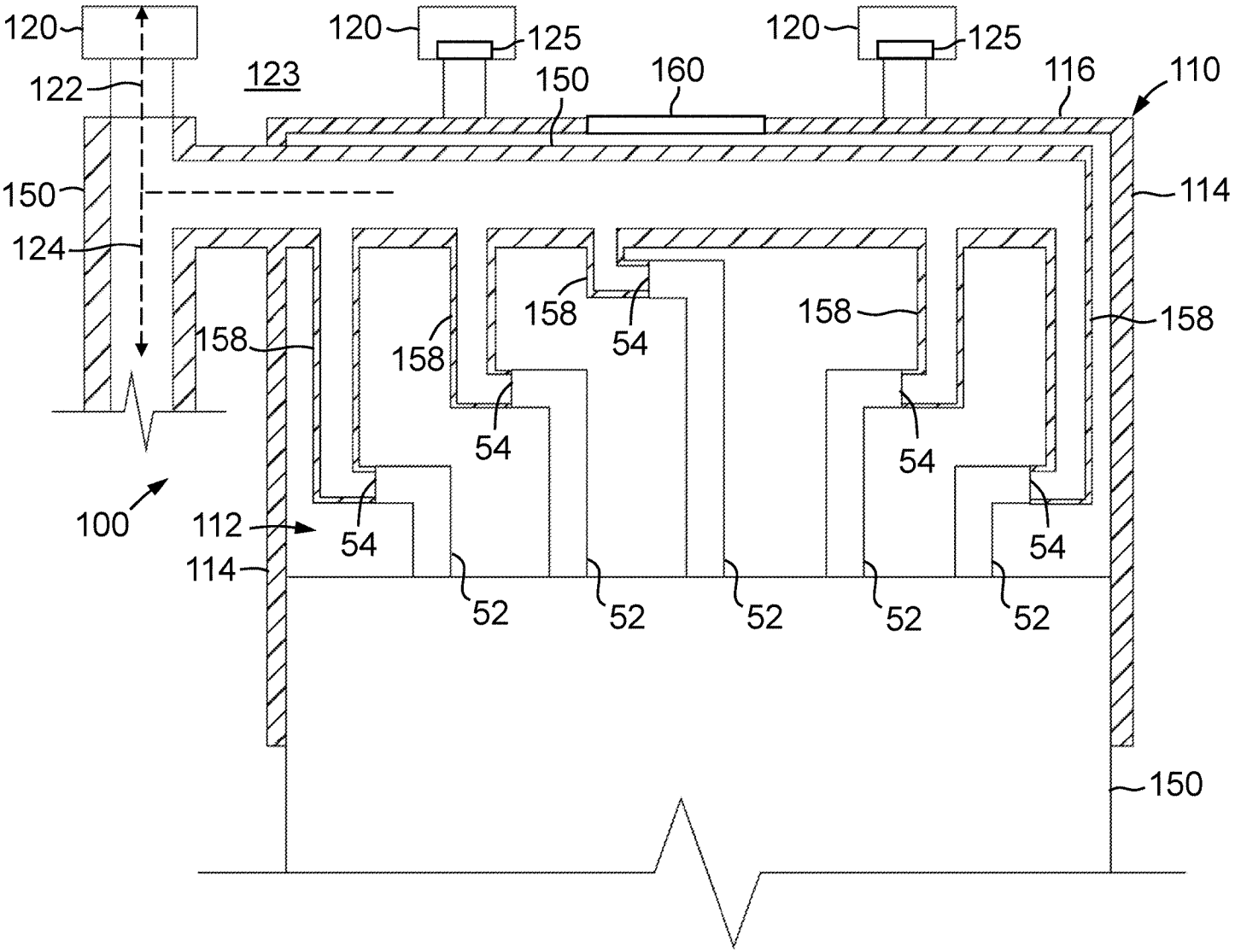
FIG. 9 is a cross-sectional view taken along section A-A in FIG. 3 according to some embodiments of the disclosure.

As shown in FIG. 9, as previously described, in some embodiments, exhaust is output from the outlets 54 of the exhaust pipes 52 into the enclosure 112, and then the exhaust may be flowed out of the enclosure 112 via the one or more first flow paths 122 or one or more second flow paths 124. However in some embodiments, the collection pipe 150 may be individually connected to the outlets 54 of one or more of the exhaust pipes 52 via a plurality of pipe connections 158. The pipe connections 158 (or more simply "connections" 158) may include any suitable conduit and/or connector that may connected to and thus in fluid communication with the outlets 54 to the collection pipe 150. For instance, in some embodiments, the pipe connections 158 may include pipes, hoses, tubing, or some combination thereof. During operations with the embodiment depicted in FIG. 9, exhaust emitted from the outlets 54 of the exhaust pipes 52 may flow directly into the collection pipe 150 via the plurality of pipe connections 158 and may thus bypass (and not flow into) the enclosure 112 defined by cap 110. In some embodiments, the pipe connection 158 may route exhaust from one or more of the exhaust pipes 52 separately from exhaust from one or more others of the exhaust pipes 52. For instance, one or more of the exhaust pipes 52 may output exhaust to an exhaust cleaning system 200 via the pipe connections 158 and collection pipe 150 and one or more others of the exhaust pipes 52 may output exhaust to the atmosphere 123 and/or another exhaust cleaning system 200 via the enclosure 112 and another collection pipe 150 (not shown) connected to cap 110.

As is shown in FIG. 9, for embodiments that include pipe connections 158 for individually connecting the outlet 54 of exhaust pipes 52 to collection pipe 150, the one or more first flow paths 122 may extend from the collection pipe 150 through one or more vents 120 (or one or more vents 160) connected to collection pipe 150. Thus, in these embodiments, the first flow path(s) 122 may bypass the enclosure 112. Vent(s) 120, 160 may also be positioned on the cap 110 (e.g., along planar top 116) to allow exhaust (or other fluid) to vent from enclosure 112 (e.g., in the event the exhaust is leaking from pipes 52, connections 158, collection pipe 150, etc.). In addition, for the embodiment of FIG. 9, the second flow path 124 may extend though the collection pipe 150 toward the deck 12 and coupling 152 as shown in FIG. 4 and previously described.

Figure 10:
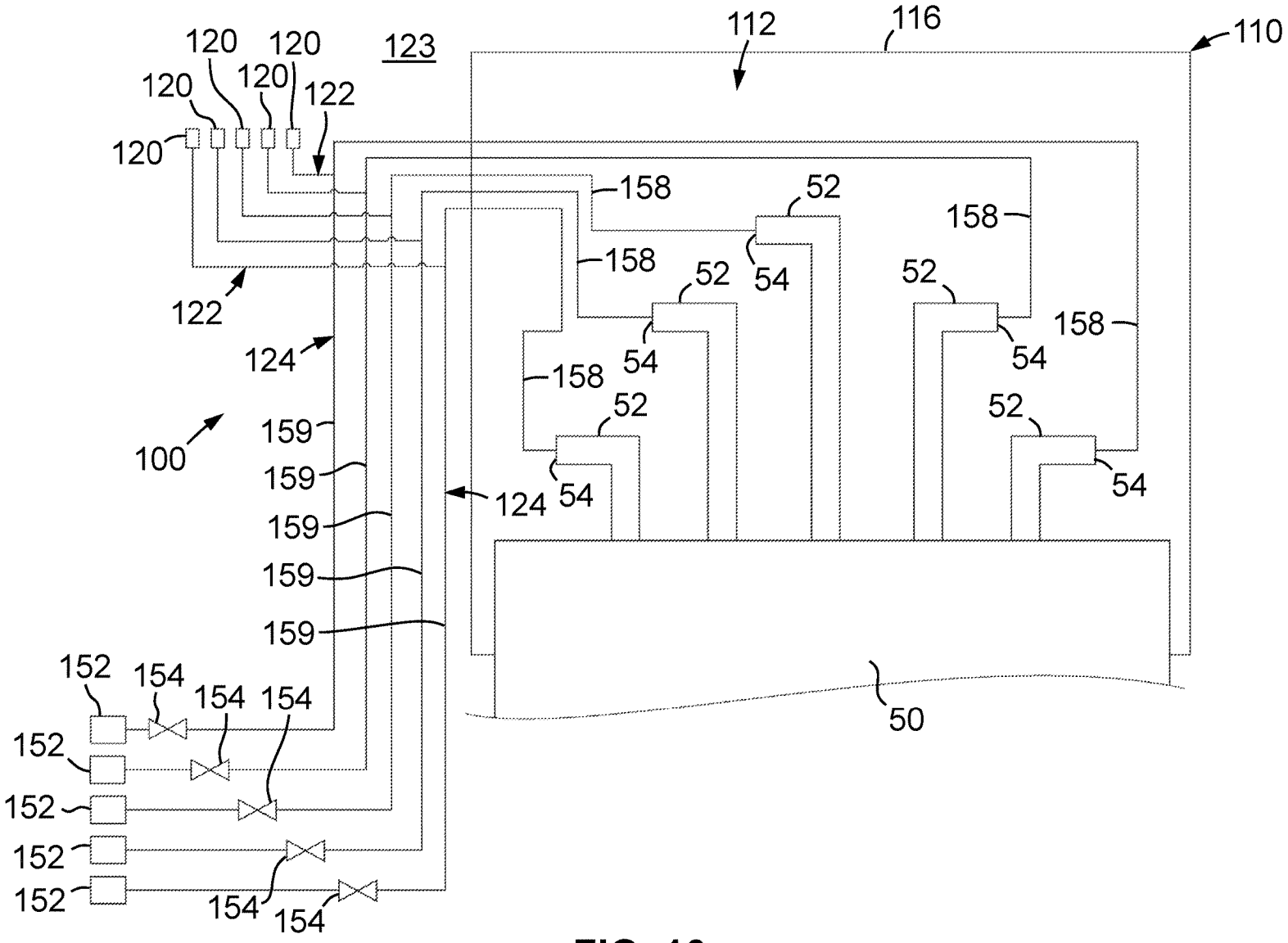
FIG. 10 is a schematic view of the cap of the exhaust handling system of the marine vessel of FIG. 1 according to some embodiments of the disclosure.

As shown in FIG. 10, in some embodiments, each pipe connection 158 may independently route the exhaust emitted from the corresponding exhaust pipe 52 out of the enclosure 112 of cap 110 via a separate collection pipe 159. Thus, in these embodiments, the common collection pipe 150 may be omitted. However, in some embodiments, each of the separate collection pipes 159 (or some of the collection pipes 159) may be nested within the common collection pipe 150. As shown in FIG. 10, in some embodiments, the separate collection pipes 159 may independently route exhaust from the outlets 54 of exhaust pipes 52 to the surrounding atmosphere 123 or to one or more exhaust cleaning assemblies (such as, exhaust cleaning assembly 200). For instance, within each of the separate collection pipes 159, a first flow path 122 may be defined that routes exhaust from the corresponding collection pipe 159 and out to the surrounding atmosphere 123 via a vent 120 that is connected to the corresponding collection pipe 159. In addition, within each of the separate collection pipes 159, a second flow path 124 may be defined that routes exhaust from the corresponding collection pipe 159 toward a coupling 152 connected to the corresponding collection pipe 159 and accessible from the deck 12 of the marine vessel 10 (FIG. 4). Each of the couplings 152 (or some of the couplings 152) connected to the separate collection pipes 159 may be connected (such as, via a conduit such as conduit 202 shown in FIGS. 4 and 7) to an exhaust cleaning assembly (e.g., exhaust cleaning assembly 200 shown in FIGS. 4 and 5) when the marine vessel 10 is at a berthing location as previously described.

Reference is now generally made to FIGS. 11A-11D, in which an example sequence or method for routing exhaust from the marine vessel 10 via the exhaust handling system 100 when the marine vessel 10 is positioned at a berthing location 250 (such that the marine vessel 10 is berthed) and when the marine vessel 10 is traveling into and out of the berthing location 250 is shown according to some embodiments. In describing the sequence shown in FIGS. 11A-11D, continuing reference will be made to the various features of embodiments of marine vessel 10 and exhaust handling system 100 shown in FIGS. 1-10 and previously described above.

Figure 11B:
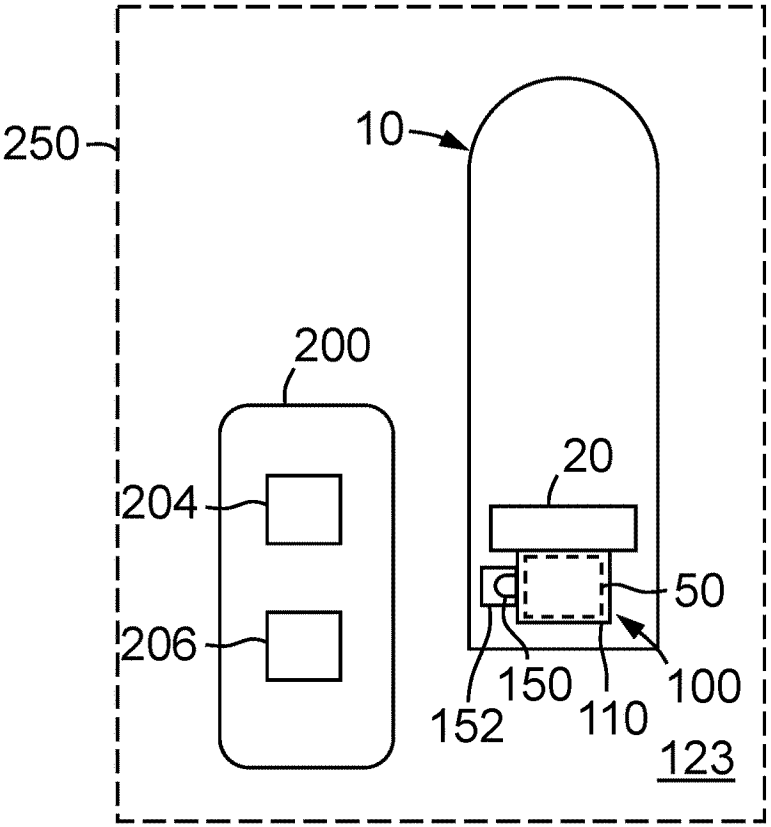
FIGS. 11A-11D are sequential top views of a sequence or method for routing exhaust from the marine vessel of FIG. 1 via the exhaust handling system when the marine vessel is berthed at a berthing location and when the marine vessel is traveling into and out of the berthing location according to some embodiments of the disclosure.
Figure 11A:
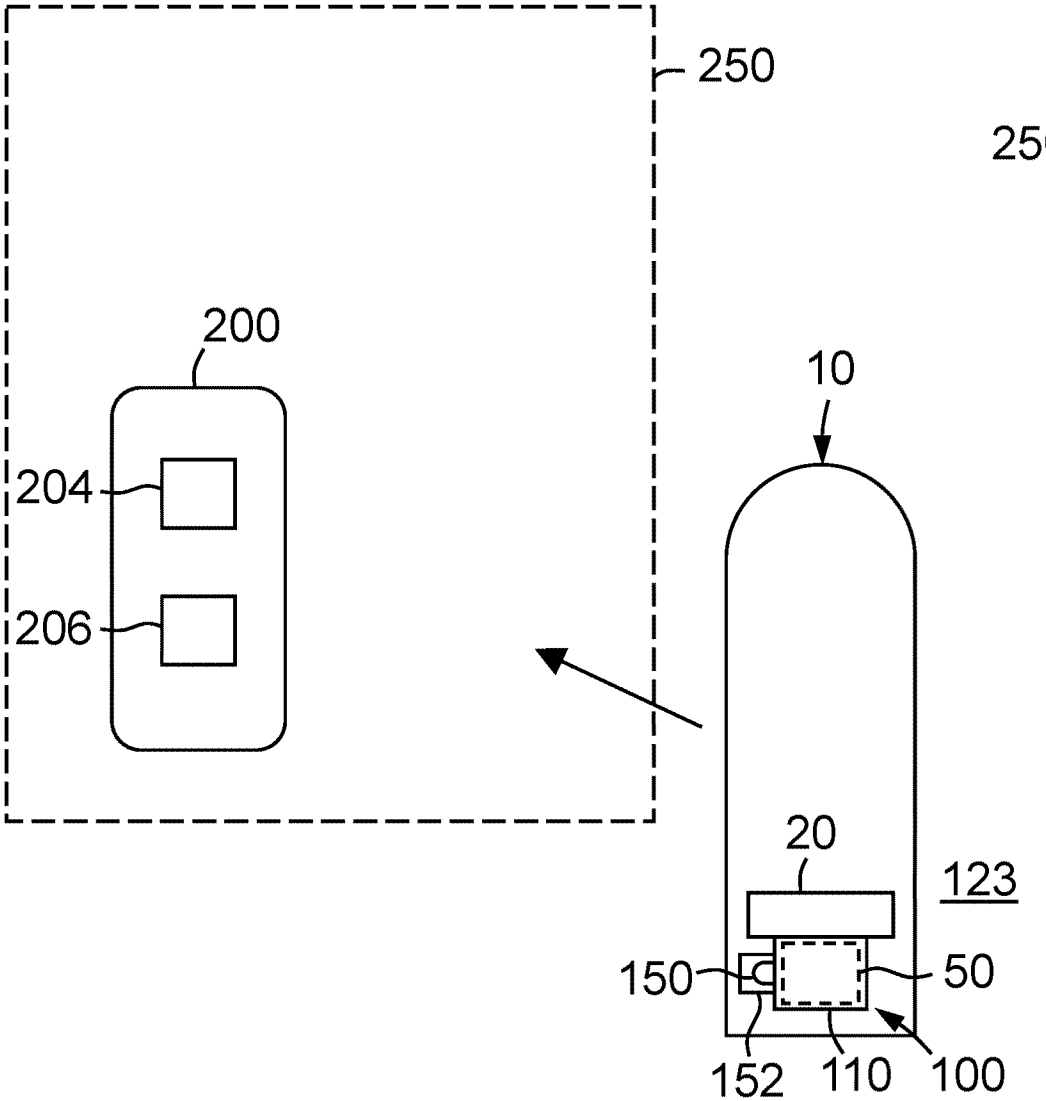

Initially, as shown in FIGS. 11A and 11B, the marine vessel 10 may travel toward the berthing location 250. For instance, as previously described, the berthing location 250 may include a port, dock, harbor, mooring, etc., and the marine vessel 10 may travel to the berthing location 250 for any suitable reason (such as to offload or receive cargo, undergo repairs, refuel, offload or receive personnel, undergo inspection, etc.). When the marine vessel 10 is traveling (such as across a body of water such an ocean, lake, channel, etc.), the exhaust emitted from exhaust stack 50 (particularly from the exhaust pipes 52 extending through exhaust stack 50), may be vented to the surrounding atmosphere 123 via the first flow path(s) 122 (FIG. 4) extending out of the cap 110. An exhaust cleaning assembly 200 may be positioned at (or accessible from) the berthing location 250 as previously described. For instance, as previously described, the exhaust cleaning assembly 200 may be positioned on a barge that is floating on the water within the berthing location 250, or the exhaust cleaning assembly 200 may be positioned onshore at the berthing location 250 (or at a remote location from the berthing location 250 and accessible via pipeline or other suitable infrastructure as previously described).

Figure 11D:
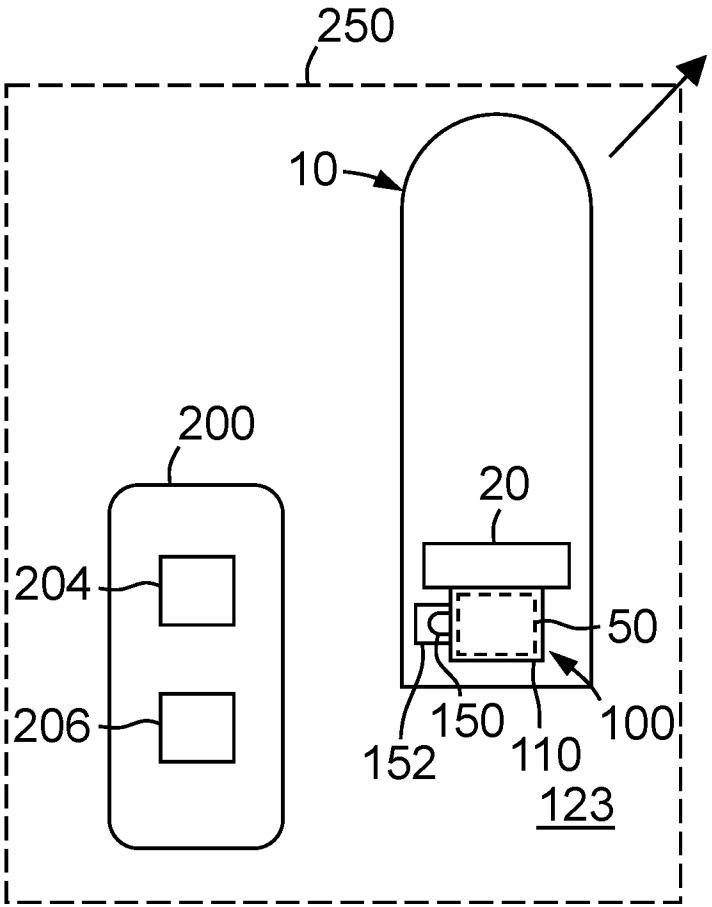
Figure 11C:
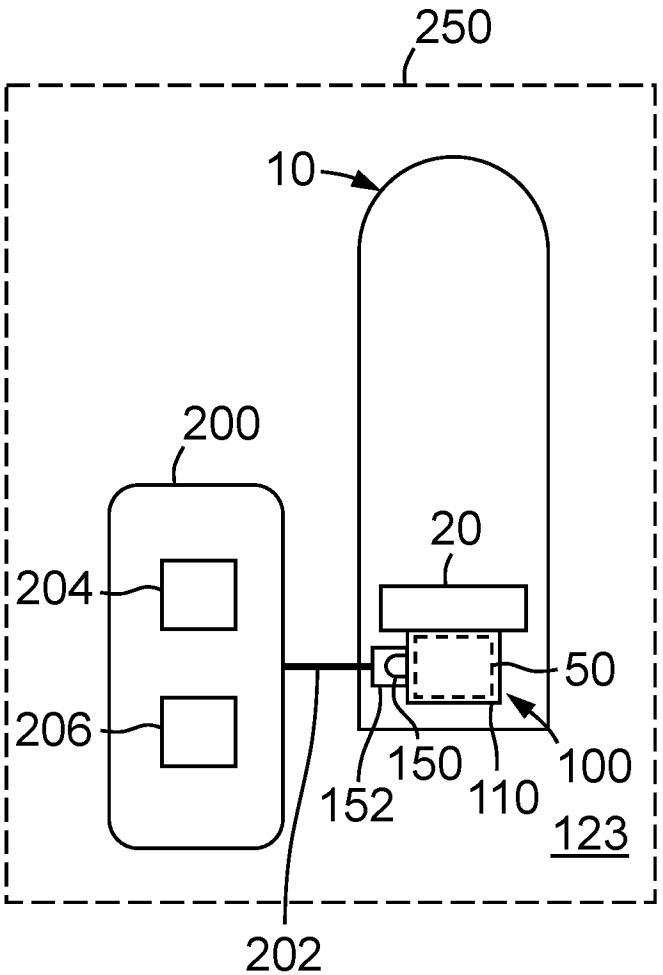

As shown in FIG. 11C, once the marine vessel 10 is positioned within the berthing location 250, the exhaust handling system 100 may be fluidly connected to the exhaust cleaning assembly 200 via coupling 152 and conduit 202 as previously described. As a result, while the marine vessel 10 is berthed, any exhaust emitted from the exhaust stack 50 (particularly from the one or more exhaust pipes 52) may be flowed to the exhaust cleaning assembly 200 via the exhaust handling system 100 to be stored (such as in the one or more tanks 204), cleaned (such as via the one or more reactors 206), or otherwise processed as previously described. Thereafter, as shown in FIG. 11D, when the time comes for marine vessel 10 to depart from the berthing location 250, the exhaust cleaning assembly 200 may be disconnected from the exhaust handling system 100, and the marine vessel 10 may travel out of and away from the berthing location 250. Once the exhaust handling system 100 is disconnected from exhaust cleaning assembly 200 and while marine vessel 10 is traveling out of and away from the berthing location 250, any exhaust emitted from exhaust stack 50 (particularly the one or more exhaust pipes 52) may once again be emitted to the surrounding atmosphere 123 via the first flow path(s) 122 (FIG. 4) extending out of the cap 110.

Thus, exhaust emitted from the exhaust stack 50 of marine vessel 10 may be continuously vented via the exhaust handling system 100 both when the marine vessel 10 is berthed (such as at the berthing location 250) and when the marine vessel 10 is away from the berthing location 250 (and traveling to and away therefrom). By permanently fixing and integrating the exhaust handling system 100 (including cap 110 and collection pipe 150) onto the marine vessel 10, personnel may simply connect the conduit 202 to the coupling 152 upon arrival at the berthing location 250, thereby eliminating the need to use heavy-lift equipment, such as a crane, to transfer or place a temporary cap atop the exhaust stack 50 once the marine vessel 10 arrives at the berthing location 250. Accordingly, when the marine vessel 10 is berthed (such as at a berthing location) exhaust-emitting systems (such as exhaust-emitting systems 60 shown in FIG. 2) may continue to operate so as to support operation of the marine vessel 10 and any sub-systems thereof, and exhaust may be prevented (or restricted) from being emitted into the surrounding atmosphere 123 within the berthing location 250. As a result, the air quality of a berthing location 250 may be maintained, even is multiple marine vessels 10 are positioned therein.

Figure 12:
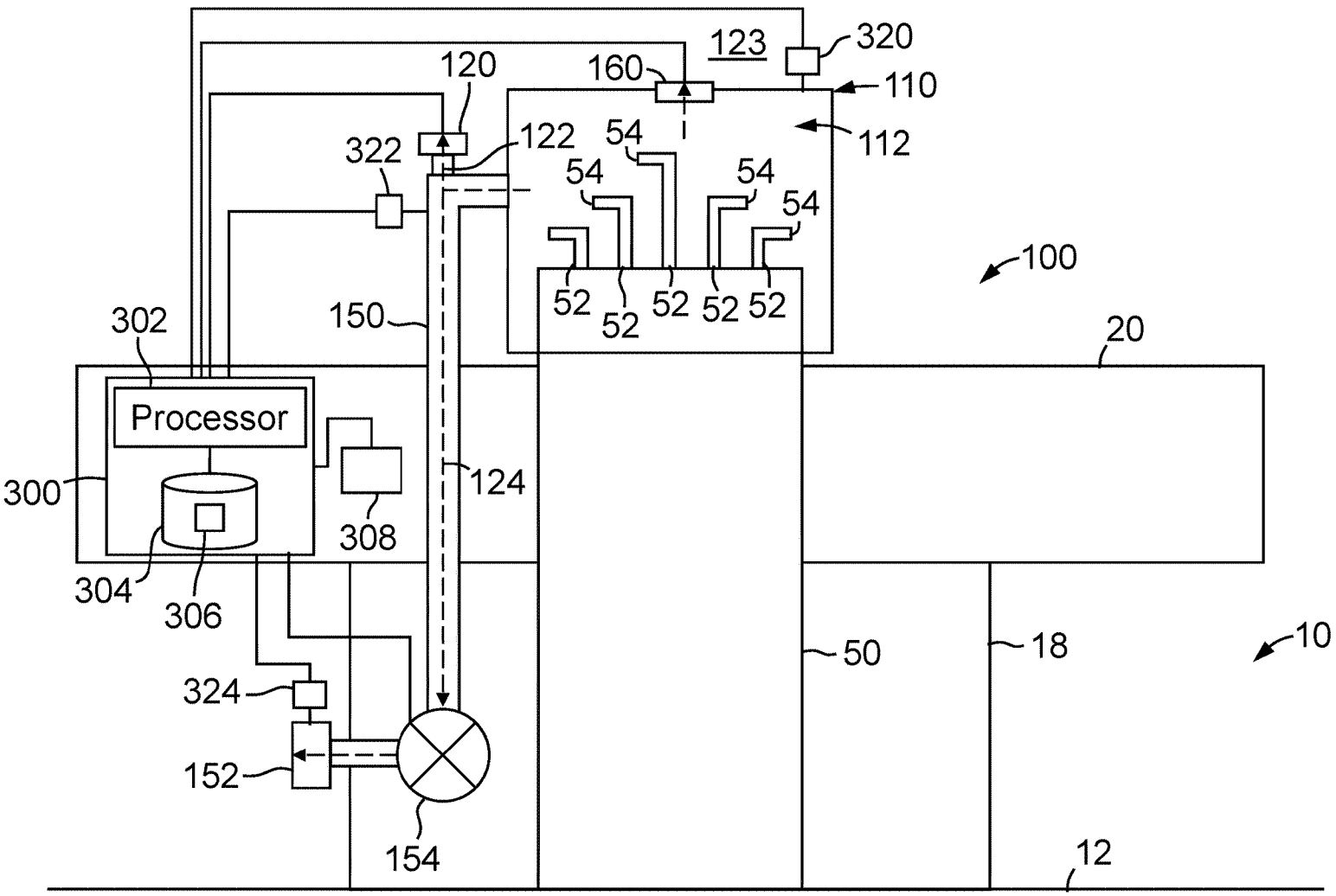
FIG. 12 is a schematic view of the exhaust handling system of the marine vessel of FIG. 1 further showing a controller for controlling the flow of exhaust from the marine vessel via the exhaust handling system according to some embodiments of the disclosure.

As shown in FIG. 12, in some embodiments, a controller 300 may be used to control the flow of exhaust through the exhaust handling system 100 during operation of the marine vessel 10 both when the marine vessel 10 is berthed (for example, at berthing location 250 shown in FIGS. 11A-11D) and when the marine vessel 10 is not berthed. The controller 300 may be (or may be incorporated within) a main or master controller onboard the marine vessel 10, or the controller 300 may be a standalone controller 300 for controlling the flow of exhaust through the exhaust handling system 100. In either case, the controller 300 may be described and referred to herein as being a part of the exhaust handling system 100. The controller 300 may be positioned onboard the marine vessel 10, such as on the bridge 20; however, controller 300 may be positioned at any location (or distributed among multiple locations) onboard or off the marine vessel 10.

The controller 300 may be a computing device, such as a computer, tablet, smartphone, server, or other computing device or system. Thus, controller 300 may include a processor 302 and a memory 304. The processor 302 may include any suitable processing device or a collection of processing devices. In some embodiments, the processor 302 may include a microcontroller, central processing unit (CPU), graphics processing unit (GPU), timing controller (TCON), scaler unit, or some combination thereof. During operations, the processor 302 executes machine-readable instructions (such as machine-readable instructions 306) stored on memory 304, thereby causing the processor 302 to perform some or all of the actions attributed herein to the controller 300. In general, processor 302 fetches, decodes, and executes instructions (e.g., machine-readable instructions 306). In addition, processor 302 may also perform other actions, such as, making determinations, detecting conditions or values, etc., and communicating signals. If processor 302 assists another component in performing a function, then processor 302 may be said to cause the component to perform the function.

The memory 304 may be any suitable device or collection of devices for storing digital information including data and machine-readable instructions (such as machine-readable instructions 306). For instance, the memory 305 may include volatile storage (such as random access memory (RAM)), non-volatile storage (e.g., flash storage, read-only memory (ROM), etc.), or combinations of both volatile and non-volatile storage. Data read or written by the processor 302 when executing machine-readable instructions 306 can also be stored on memory 304. Memory 304 may include "non-transitory machine-readable medium," where the term "non-transitory" does not include or encompass transitory propagating signals.

The processor 302 may include one processing device or a plurality of processing devices that are distributed within controller 300 or more broadly within marine vessel 10. Likewise, the memory 304 may include one memory device or a plurality of memory devices that are distributed within controller 300 or more broadly within marine vessel 10.

The controller 300 may be communicatively connected (such as via wired and/or wireless connection) to a user interface 308 (such as a monitor, display, computing device, touch-sensitive screen or other surface, keyboard, mouse, or some combination thereof). During operations, a user (e.g., personnel onboard the marine vessel 10) may view information output from the controller 300 on the user interface 308 (such as the position or status of one or more of the sensors 320, 322, vent(s) 120, vent(s) 160, valve 154, coupling 152, etc.). In addition, during operations, a user may make inputs to the controller 300 via the user interface 308 (such as commands to open valve 154 and/or vent(s) 120, 160).

Controller 300 may be connected to various sensors (such as sensors 320, 322) positioned throughout the exhaust handling system 100. For instance, controller 300 may be connected to a pressure sensor 320 that is connected to the cap 110 and configured to detect or measure a pressure within the enclosure 112 (or value indicative thereof). In addition, controller 300 may be connected to a pressure sensor 322 that is connected to the collection pipe 150 and configured to detect or measure a pressure within the collection pipe 150 (or a value indicative thereof). The pressure sensors 320, 322 may be any suitable device that is configured to measure, detect, or determine a pressure (or value indicative thereof) within a given area, volume, location. For instance, in some embodiments, the pressure sensors 320, 322 may include strain gauges, capacitance-based pressure sensors, solid-state pressure sensors, manometers, barometers, resistive pressure sensors, etc.

In addition, controller 300 may be connected to the valve 154 positioned along collection pipe 150 and the one or more vents 120, 160 (note: one vent 120 positioned along collection pipe 150 and one vent 160 positioned on the cap 110 are shown in FIG. 12, but any one or more of the vents 120 and/or vents 160 shown in FIG. 4 may be included and connected to controller 300 in some embodiments). For instance, the valve 154 and/or the one or more vents 120, 160 may include motorized or actuatable valves that may be transitioned between the open and closed positions (previously described above) via the controller 300 (or a command or signal generated thereby). In addition, controller 300 may be connected to the valve 154 and/or the one or more vents 120, 160 such that controller 300 may determine a position (such as open, closed, or a position between fully open or fully closed) of the valve 154 and/or the one or more vents 120, 160. For instance, the valve 154 and/or the one or more vents 120, 160 may include or be connected to a driver such as a stepper motor, servo-motor, or other suitable device that may controllably place the valve 154 and/or the one or more vents 120, 160 in a particular position. The controller 300 may determine a position of the valve 154 and/or the one or more vents 120, 160 via the previous actuation(s) of the drivers (e.g., stepper motor, servo-motor, etc.). In some embodiments, one or more additional sensors or devices, such as position sensors, proximity sensors, pressure sensors (e.g., differential pressure sensors), optical sensors, etc. may be utilized by controller 300 to determine a position of the valve 154 and/or the one or more vents 120, 160 during operations.

Further, controller 300 may be connected to a sensor 324 that is configured to detect whether a conduit (such as conduit 202 shown in FIGS. 7, 8, and 11C) is connected to the coupling 152 of collection pipe 150. The sensor 324 may include a proximity sensor, optical sensor, magnetic sensor, switch, or any other suitable device that may be configured to detect when a conduit (or coupling connected thereto) is engaged with the coupling 152 such that exhaust flowing out of the collection pipe 150 may be directed to another location or system (such as exhaust cleaning assembly 200 shown in FIGS. 7, 8, and 11A-11C).

During operations, controller 300 may selectively actuate the valve 154 and/or the vent(s) 120, 160 between the open and closed positions so as to route the exhaust emitted from the one or more exhaust pipes 52 either via the first flow path(s) 122 or the second flow path 124. For instance, when marine vessel 10 is at berth (e.g., such as shown in FIGS. 9B and 9C previously described above), and a conduit (e.g., conduit 202) is engaged with the coupling 152, the controller 300 may open the valve 154 and close the vent(s) 120, 160 so that exhaust emitted form the one or more exhaust pipes 52 may be directed along the second flow path 124 and out of the coupling 152 and into an exhaust cleaning assembly (such as exhaust cleaning assembly 200) as previously described. In addition, when an exhaust cleaning assembly is not connected to the collection pipe 150 (such as via a conduit connected to coupling 152), such as when the marine vessel 10 is not at berth, the controller 300 may close the valve 154 and open one or more of the vent(s) 120, 160 to allow exhaust emitted from the one or more exhaust pipes 52 to be vented to the surrounding atmosphere 123. Further, in some embodiments, regardless as to whether the marine vessel 10 is at berth or not at berth (and thus regardless as to whether an exhaust cleaning assembly is connected to the collection pipe 150 via coupling 152) the controller 300 may actuate one or more of the vents 120, 160 to open (and thereby vent exhaust to the surrounding atmosphere 123) in response to a determination (e.g., by the controller 300) that the pressure within the enclosure 112 and/or within the collection pipe 150 is above a threshold. The controller 300 may determine the pressure within the enclosure 112 and within the collection pipe 150 based on outputs received from the sensors 320, 322. In some embodiments, one or more temperature sensors (e.g., a thermocouple, thermistor, resistance temperature detector (RTD), semiconductor circuit, etc.) may be connected to the exhaust handling system 100 (such as to enclosure 112, collection pipe 150, etc.), and the controller 300 (alternatively or additionally) may actuate the one or more vents 120 to open (and thereby vent exhaust to the atmosphere 123) in response to a determination (such as by the controller 300) that the temperature within the enclosure 112 and/or the collection pipe 150 is above a threshold.

As shown in FIGS. 10 and 12, in some embodiments, the exhaust pipes 52 (or some of the exhaust pipes 52) may be connected to separate collection pipes 159 that are further connected to separate vents 120, 160, valves 154, and couplings 152 as previously described. In these embodiments, the controller 300 may be connected to one or more pressure and/or temperature sensors (such as pressure sensos 320, 322) that are configured to detect a pressure and/or temperature within the separate collection pipes 159. In addition, the controller 300 may be connected to the couplings 152 and valves 154 of the separate collection pipes 159. During operations, the controller 300 may direct exhaust through either the first flow path 122 or the second flow path 124 within each of the separate exhaust pipes 159 via actuation of the separate valves 154 and vent(s) 120, 160 in a similar manner to that previously described for the common collection pipet 150 shown in FIG. 12.

In some embodiments the vent(s) 120, 160 may be pressure-actuated as previously described. Thus, during operations, one or more of the vents 120, 160 may open or close based on a pressure within the enclosure 112 or collection pipe 150 (or the separate collection pipes 159) regardless of a position of the valve 154 and/or connection status of the coupling 152 (such as whether the coupling 152 is connected to or not connected to a conduit of an exhaust cleaning assembly such as the conduit 202 and exhaust cleaning assembly 200 shown in FIGS. 7 and 8). Thus, in some embodiments, the controller 300 may not be connected to the one or more vent(s) 120, 160 of the exhaust handling system 100.

Figure 13:
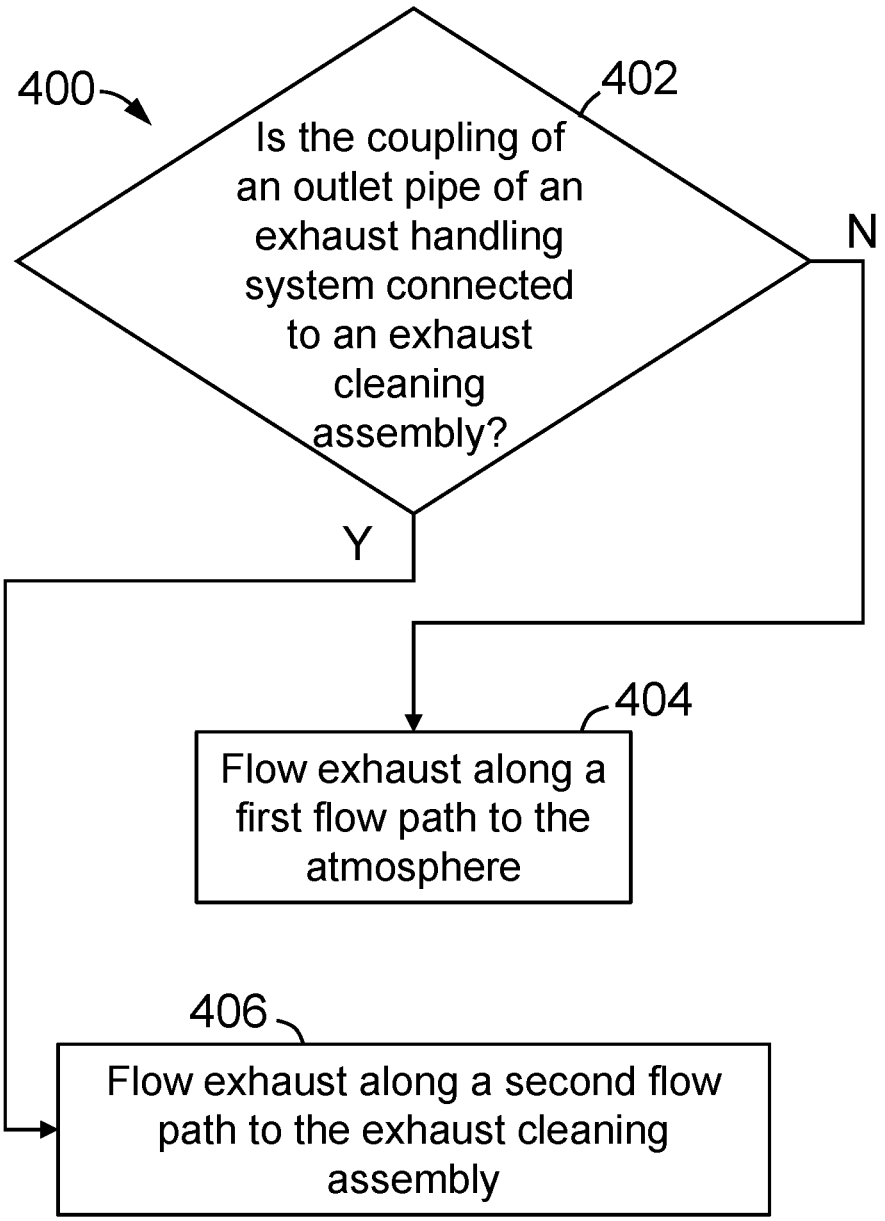
FIGS. 13 and 14 are diagrams of methods for flowing the exhaust of a marine vessel through an exhaust handling system according to some embodiments of the disclosure.
Figure 14:
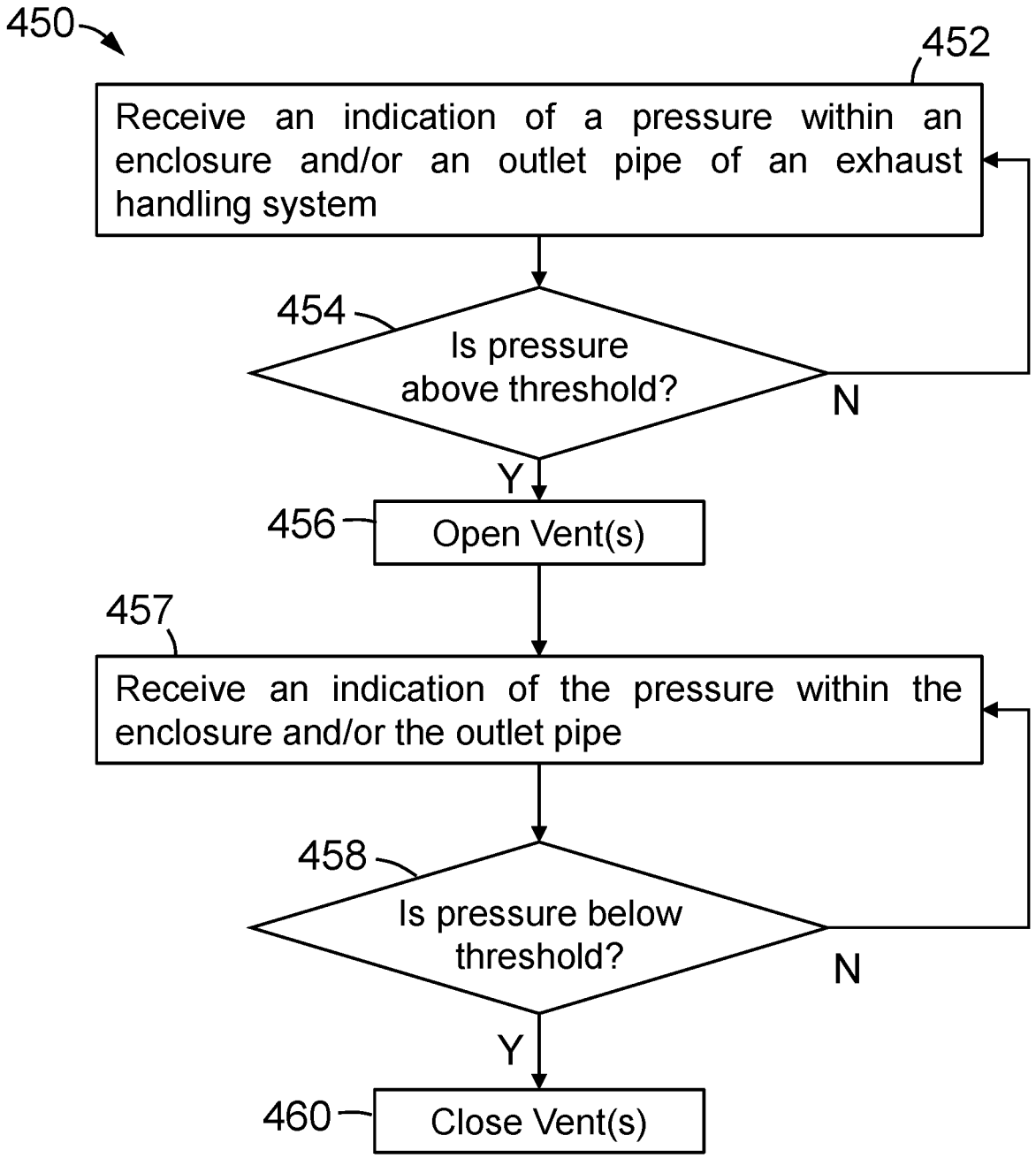

Reference is now made to FIGS. 13 and 14, in which methods 400, 450 for flowing the exhaust of a marine vessel through an exhaust handling system (such as the exhaust handling system 100) are shown according to some embodiments. The method 400 may include a method for flowing the exhaust emitted from the marine vessel (such as marine vessel 10) along a first flow path to the atmosphere or a second flow path to an exhaust cleaning assembly (such as exhaust cleaning assembly 200 shown in FIGS. 7 and 8), and the method 450 may include a method for flowing exhaust to the atmosphere based on a pressure within the exhaust handling system (such as exhaust handling system 100). In some embodiments, the methods 400, 450 may be performed (wholly or partially) by the processor of a controller (such as processor 302 of controller 300 shown in FIG. 12). Thus, the methods 400, 450 may be representative of the machine-readable instructions 306 stored on memory 304, or some of the machine-readable instructions 306 for some embodiments of controller 300 (FIG. 12). In addition, in describing the features of methods 400, 450, continuing reference will be made to the features of the embodiments shown in FIGS. 1-12 and previously described. In some embodiments, the methods 400, 450 may be performed in parallel (such as by processor 302), and/or may be combined or integrated with one another.

The method 400 shown in FIG. 13 may initially include a determination, at block 402, as to whether a coupling of a collection pipe of an exhaust handling system (such as exhaust handling system 100) is connected to an exhaust cleaning assembly (such as exhaust cleaning assembly 200). For instance, as shown in FIG. 12 and previously described, the controller 300 may determine whether a conduit 202 of an exhaust cleaning assembly 200 (FIGS. 7 and 8) is connected to the coupling 152 of collection pipe 150 via an output from the sensor 324 as previously described.

If it is determined that the coupling of the collection pipe is not connected to an exhaust cleaning assembly (the determination at block 402 is "No" or "N"), the method 400 may proceed to flow exhaust emitted from the marine vessel 10 along a first flow path to the atmosphere (for example, atmosphere 123) at block 404. For instance, as shown in FIG. 12 and previously described, in some embodiments, the controller 300 may determine that a conduit 202 of an exhaust cleaning assembly 200 is not connected to coupling 152 of collection pipe 150 via an output from the sensor 324, and may thus close the valve 154 and open one or more of the vent(s) 120, 160 (or allow the vent(s) 120, 160 to open via pressure actuation as previously described) so as to flow the exhaust emitted from the one or more exhaust pipes 52 into the surrounding atmosphere 123 via the one or more first flow paths 122.

Conversely, if it is determined that the coupling of the collection pipe is connected to an exhaust cleaning assembly (the determination at block 402 is "Yes" or "Y"), the method 400 may proceed to flow exhaust emitted from the marine vessel 10 along a second flow path to the exhaust cleaning assembly at block 406. For instance, as shown in FIG. 12 and previously described, in some embodiments, the controller 300 may determine that a conduit 202 is connected is connected to the coupling 152 via an output from the sensor 324, and may thus may open the valve 154 and (potentially) close the vent(s) 120, 160 so as to flow the exhaust emitted from the one or more exhaust pipes 52 along the second flow path 124 to the exhaust cleaning assembly 200.

The method 450 shown in FIG. 14 may initially include receiving an indication of a pressure within an enclosure and/or a collection pipe of an exhaust handling system (such as exhaust handling system 100) at block 452. For instance, as shown in FIG. 12 and previously described, the controller 300 may receive an indication of a pressure within the enclosure 112 and/or the collection pipe 150 via outputs from the pressure sensor 320 and/or the pressure sensor 322, respectively.

Next, method 450 includes determining whether the pressure (such as the pressure within the enclosure 112 and/or the pressure within the collection pipe 150) is above a threshold at block 454. For instance, block 454 may include determining whether a particular one or either of the pressures within the enclosure (e.g., enclosure 112) of the collection pipe (e.g., collection pipe 150) is above a threshold. In some embodiments, block 454 may include determining whether the pressure within the enclosure (for example, enclosure 112) is above a first threshold and/or whether the pressure within the collection pipe (for example, collection pipe 150) is above a second threshold, wherein the first and second thresholds are different. The threshold (or thresholds) may be determined based upon an operating pressure (or pressure range) of the enclosure (for example, enclosure 112) and/or the collection pipe (e.g., collection pipe 150).

If it is determined that a pressure within the enclosure and/or the collection pipe is above a threshold (the determination at block 454 is "Yes" or "Y"), method 450 may proceed to open one or more vents to vent exhaust from the enclosure and/or the collection pipe block 456. For instance, as shown in FIG. 12 and previously described, if the controller 300 determines that the pressure within the exhaust handling system 100 (including the enclosure 112 and/or the collection pipe 150) is above a threshold, the controller 300 may open one or more of the vent(s) 120 or the vent(s) 160 so as to flow the exhaust out of the enclosure 112 and/or collection pipe 150 to the surrounding atmosphere 123 in an effort to reduce the pressure below the threshold. Conversely, if it is determined that a pressure within the enclosure and/or the collection pipe is not above a threshold (the determination at block 454 is "No" or "N"), method 450 may repeat block 452 and continue monitoring the pressure within the enclosure and/or the collection pipe.

If the vent(s) (for example, vent(s) 120, vent(s) 160) are open via block 456, method 450 may proceed to once again receive and indication of the pressure within the enclosure and/or the collection pipe at block 457 and then determine whether the pressure within the enclosure and/or the collection pipe 150 is below a threshold at block 458. The indication of the pressure received at block 457 may be obtained in a similar manner to that described above for block 452. The threshold at block 458 may be same or different from the threshold in block 454. In some embodiments, the threshold at block 458 may be lower than the threshold at block 454. The threshold at block 458 may be determined such that the pressure within the enclosure and/or the collection pipe is within a desired or operating range (potentially including a safety factor). If it is determined that the pressure is below the threshold at block 458 (the determination at block 458 is "Yes" or "Y"), method 450 may proceed to close the vent(s) at block 460. For instance, as shown in FIG. 12 and previously described, if the controller 300 determines that the pressure within the enclosure 112 and/or collection pipe 150 is below a threshold (or within a desired range) (such as via the sensors 320, 322) after the vent(s) 120 and/or the vent(s) 160 have been opened to direct exhaust to the atmosphere 123, the controller 300 may close the vent(s) 120, 160. In some embodiments, closing the vent(s) 120, 160 may allow the exhaust to flow along the second flow path 124 toward the exhaust cleaning assembly (such as exhaust cleaning assembly 200) as previously described.

Conversely, if it is determined that the pressure within the enclosure and/or the collection pipe is not below the threshold at block 458 (the determination at block 458 is "No" or "N"), method 450 may repeat back to block 457 to once again receive and indication of the pressure, and then determine whether the pressure within the enclosure and/or the collection pipe is below the threshold at block 458. For instance, as shown in FIG. 12 and previously described, if after opening the vent(s) 120, 160, the controller 300 determines is still above a threshold (and is therefore above a desired range), the controller 300 may maintain the vent(s) 120, 160 in the open position and continue to monitor the pressure within the enclosure 112 and/or the collection pipe 150 via the sensors 320, 322 as previously described.

As explained above and reiterated below, this disclosure includes, without limitation, the following example embodiments.

Example Embodiment 1: an exhaust handling system for a marine vessel, the exhaust handling system comprising: a cap connected to a top end portion of an exhaust stack of the marine vessel so as to form an enclosure that at least partially surrounds an outlet of an exhaust pipe extending through the exhaust stack; a collection pipe in fluid communication with the cap such that the collection pipe is configured to receive exhaust from the enclosure; and a coupling connected to the collection pipe that is configured to connect to an exhaust cleaning assembly, the exhaust cleaning system including at least one tank to receive the exhaust, the cap at least partially defines a first flow path for the exhaust to flow from the enclosure to an atmosphere surrounding the cap, and the collection pipe at least partially defines a second flow path for the exhaust to flow from the enclosure to the coupling via the collection pipe.

Example Embodiment 2: the exhaust handling system of any example embodiment, wherein the cap is connected to the exhaust stack such that the cap is supported by the exhaust stack.

Example Embodiment 3: the exhaust handling system of any example embodiment, wherein the cap is welded to the exhaust stack.

Example Embodiment 4: the exhaust handling system of any example embodiment, further comprising a vent, connected to the cap, wherein the vent at least partially defines the first flow path, and wherein the vent includes at least one valve member that is configured to actuate between: an open position to emit exhaust to the atmosphere via the first flow path; and a closed position to prevent emission of exhaust to the atmosphere via the first flow path.

Example Embodiment 5: the exhaust handling system of any example embodiment, wherein the vent comprises a pressure-actuated vent.

Example Embodiment 6: the exhaust handling system of any example embodiment, wherein the at least one valve member comprises a plurality of louvers that are rotatable to transition the vent between the open position and the closed position.

Example Embodiment 7: the exhaust handling system of any example embodiment, wherein the coupling is proximate to a deck of the marine vessel.

Example Embodiment 8: the exhaust handling system of any example embodiment, further comprising a cleanout port positioned along the collection pipe that is proximate to the deck of the marine vessel, wherein the cleanout port is configured to provide access into the collection pipe independent of the coupling.

Example Embodiment 9: the exhaust handling system of any example embodiment, further comprising a pipe connection positioned within the enclosure that is in fluid communication with the exhaust pipe such that exhaust pipe is configured to output exhaust into the pipe connection.

Example Embodiment 10: the exhaust handling system of any example embodiment, wherein the pipe connection is connected to the collection pipe such that exhaust emitted from the exhaust pipe is routed into the collection pipe via the pipe connection.

Example Embodiment 11: the exhaust handling system of any example embodiment, wherein the collection pipe comprises flexible ductwork.

Example Embodiment 12: an exhaust handling system for a marine vessel, the exhaust handling system comprising: a cap connected to a top end portion of an exhaust stack of the marine vessel so as to form an enclosure that at least partially surrounds an outlet of an exhaust pipe extending through the exhaust stack; a vent in fluid communication with the enclosure, the vent including at least one valve member that is actuatable between a first position to emit exhaust from the enclosure to an atmosphere surrounding the cap via the vent and a second position to prevent an emission of exhaust from the enclosure to the atmosphere via the vent; and a collection pipe in fluid communication with the enclosure; a coupling connected to the collection pipe and configured to connect to an exhaust cleaning assembly that includes at least one tank to receive the exhaust.

Example Embodiment 13: the exhaust handling system of any example embodiment, wherein the at least one valve member comprises a plurality of louvers that are rotatable to transition the vent between the first position and the second position.

Example Embodiment 14: the exhaust handling system of any example embodiment, wherein the vent comprises a pressure-actuated vent.

Example Embodiment 15: the exhaust handling system of any example embodiment, wherein the pressure-actuated vent is positioned on a top end of the cap.

Example Embodiment 16: the exhaust handling system of any example embodiment, wherein the pressure-actuated vent is positioned along the collection pipe.

Example Embodiment 17: the exhaust handling system of any example embodiment, wherein the cap is connected to the exhaust stack such that the cap is supported by the exhaust stack.

Example Embodiment 18: the exhaust handling system of any example embodiment, wherein the cap is welded to the exhaust stack.

Example Embodiment 19: the exhaust handling system of any example embodiment, wherein the coupling is proximate to a deck of the marine vessel.

Example Embodiment 20: the exhaust handling system of any example embodiment, wherein the collection pipe comprises a cleanout port that is proximate to the deck of the marine vessel, and wherein the cleanout port is configured to provide access into the collection pipe independent of the coupling.

Example Embodiment 21: the exhaust handling system of any example embodiment, further comprising a pipe connection positioned within the enclosure that is in fluid communication with the exhaust pipe and the collection pipe such that the exhaust pipe is configured to output exhaust into collection pipe via the pipe connection.

Example Embodiment 22: an exhaust handling system for a marine vessel, the exhaust handling system comprising: a cap connected to a top end portion of an exhaust stack of the marine vessel such that the cap is supported by the exhaust stack and such that the cap forms an enclosure that at least partially surrounds an outlet of an exhaust pipes extending through the exhaust stack; a pressure-actuated vent in fluid communication with the enclosure; and a collection pipe in fluid communication with the enclosure and configured to connect to an exhaust cleaning assembly that includes at least one tank to receive the exhaust.

Example Embodiment 23: the exhaust handling system of any example embodiment, wherein the pressure-actuated vent includes at least one valve member that is actuatable to selectively emit exhaust from the enclosure to an atmosphere surrounding the cap.

Example Embodiment 24: the exhaust handling system of any example embodiment, wherein the pressure-actuated vent is positioned on a top end of the cap.

Example Embodiment 25: the exhaust handling system of any example embodiment, wherein the pressure-actuated vent is positioned along the collection pipe.

Example Embodiment 26: the exhaust handling system of any example embodiment, wherein the cap is welded to the exhaust stack.

Example Embodiment 27: the exhaust handling system of any example embodiment, further comprising a coupling connected to the collection pipe that is configured to connect to a conduit of the exhaust cleaning assembly, wherein the coupling is accessible from a deck of the marine vessel.

Example Embodiment 28: the exhaust handling system of any example embodiment, wherein the collection pipe comprises a cleanout port that is accessible from the deck of the marine vessel, and wherein the cleanout port is configured to provide access into the collection pipe independent of the coupling.

Example Embodiment 29: the exhaust handling system of any example embodiment, further comprising a pipe connection positioned within the enclosure that is in fluid communication with the exhaust pipe such that the exhaust pipe is configured to output exhaust to the collection pipe via the pipe connection.

Example Embodiment 30: a method comprising: (a) positioning a marine vessel in a berthing location, the marine vessel including a deck, an exhaust stack having an top end portion positioned above from the deck, an exhaust pipe extending through the exhaust stack to an outlet that is positioned above the top end portion of the exhaust stack, a cap connected to the exhaust stack so as to form an enclosure that at least partially surrounds the outlet of the exhaust pipe, and an collection pipe in fluid communication with the enclosure; (b) connecting an exhaust cleaning assembly to the collection pipe after (a), the exhaust cleaning assembly including at least one tank to receive the exhaust; and (c) operating the marine vessel to flow an exhaust emitted from the outlet of the exhaust pipe to the exhaust cleaning assembly after (b) via the collection pipe.

Example Embodiment 31: the method of any example embodiment, further comprising: (d) emitting the exhaust out of the enclosure to an atmosphere surrounding the cap during (a).

Example Embodiment 32: the method of any example embodiment, wherein (d) further comprises flowing the exhaust out of a vent in fluid communication with the enclosure.

Example Embodiment 33: the method of any example embodiment, wherein (d) further comprises flowing the exhaust out of a pressure-actuated vent in fluid communication with the enclosure.

Example Embodiment 34: the method of any example embodiment, further comprising: (e) disconnecting the exhaust cleaning assembly from the collection pipe; (f) moving the marine vessel away from the berthing location after (e); and (g) flowing the exhaust out of the enclosure to the atmosphere during (f).

Example Embodiment 35: the method of any example embodiment, wherein (b) comprises connecting a conduit connected to the exhaust cleaning assembly to a coupling that is connected to the collection pipe and that is proximate to the deck of the marine vessel.

Example Embodiment 36: the method of any example embodiment, further comprising preventing the exhaust from flowing from the enclosure to an atmosphere surrounding the cap during (c).

Example Embodiment 37: the method of any example embodiment, wherein the exhaust cleaning assembly is positioned on a barge that is further positioned at the berthing location.

Example Embodiment 38: a method comprising: (a) positioning a marine vessel in a berthing location, the marine vessel including an exhaust stack, an exhaust pipe extending through the exhaust stack to an outlet that is positioned above a top end portion of the exhaust stack, a cap that is connected to the exhaust stack to form an enclosure that surrounds the outlet of the exhaust pipe; (b) flowing an exhaust from the enclosure to an atmosphere surrounding the cap via a first flow path during (a), the first flow path at least partially defined by the cap; (c) connecting an exhaust cleaning assembly positioned at the berthing location to the cap after (a), the exhaust cleaning system including at least one tank to receive the exhaust; and (d) flowing the exhaust from the enclosure to the exhaust cleaning assembly via a second flow path after (b), the second flow path at least partially defined by the cap.

Example Embodiment 39: the method of any example embodiment, wherein (b) further comprises flowing the exhaust out of a vent connected to the enclosure.

Example Embodiment 40: the method of any example embodiment, wherein (b) further comprises rotating at least one louver of the vent to open the vent.

Example Embodiment 41: the method of any example embodiment, further comprising: (e) disconnecting the exhaust cleaning assembly from the cap; (f) moving the marine vessel away from the berthing location after (e); and (g) flowing the exhaust out of the enclosure to the atmosphere via the first flow path during (f).

Example Embodiment 42: the method of any example embodiment, wherein (c) comprises connecting a conduit connected to the exhaust cleaning assembly to a coupling that is proximate to a deck of the marine vessel and that is in fluid communication with the enclosure.

Example Embodiment 43: the method of any example embodiment, further comprising preventing the exhaust from flowing from the enclosure to the atmosphere during (d).

Example Embodiment 44: the method of any example embodiment, wherein the exhaust cleaning assembly is positioned on a barge that is positioned at the berthing location.

As described above, the embodiments disclosed herein include exhaust handling systems for a marine vessel that are configured to allow selective collection of exhaust output from the exhaust-emitting systems of the marine vessel while at a berthing location. In some embodiments, the collected exhaust may be routed to an exhaust cleaning assembly that may store and/or process the exhaust to prevent harmful chemicals or pollutants therein from being emitted to the atmosphere. In some embodiments, the exhaust handling systems of the embodiments disclosed herein may include a cap that is connected to an upper end portion of an exhaust stack of the marine vessel so as to form an enclosure around one or more (e.g., a plurality of) exhaust pipes that emit exhaust from the exhaust-emitting systems of the marine vessel. The collected exhaust may be emitted directly to the atmosphere when the marine vessel is not at a berthing location (or during a situation that requires venting of exhaust to the atmosphere), or may be selectively routed to an exhaust cleaning assembly to avoid such atmospheric venting when the marine vessel is berthed. Accordingly, through use of the embodiments disclosed herein, the exhaust-emitting systems of a marine vessel may continue to operate when the marine vessel is berthed while preventing (or restricting) the emission of exhaust (or at least the harmful and/or polluting components thereof) to the atmosphere.

The discussion above is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the discussion herein and in the claims, the terms "including" and "comprising" are used in an open-ended fashion, and thus should be interpreted to mean "including, but not limited to . . . ." Also, the terms "couple," "couples", "connect," or "connection," are intended to mean either an indirect or direct connection. Thus, if a first device couples or connects to a second device, that connection may be through a direct connection of the two devices, or through an indirect connection that is established via other devices, components, nodes, and connections. In addition, when used herein (including in the claims), the words "about," "generally," "substantially," "approximately," and the like, when used in reference to a stated value mean within a range of plus or minus 10% of the stated value. Further, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis.

This application claims the benefit of U.S. provisional application Ser. No. 63/485,886, filed Feb. 18, 2023, and entitled "Exhaust Handling Systems for Marine Vessels and Related Methods," and U.S. provisional application Ser. No. 63/488,574, filed Mar. 6, 2023, and entitled "Exhaust Handling Systems for Marine Vessels and Related Methods," the contents of which are incorporated herein by reference in their entirety.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An exhaust handling system for a marine vessel, the exhaust handling system comprising:

a cap connected to a top end portion of an exhaust stack of the marine vessel so as to form an enclosure that at least partially surrounds an outlet of an exhaust pipe extending through the exhaust stack;

a collection pipe in fluid communication with the cap such that the collection pipe is configured to receive exhaust from the enclosure; and a coupling connected to the collection pipe that is configured to connect to an exhaust cleaning assembly, the exhaust cleaning assembly including at least one tank to receive the exhaust, whereby the cap at least partially defines a first flow path for the exhaust to flow from the enclosure to an atmosphere surrounding the cap;, and the collection pipe at least partially defines a second flow path for the exhaust to flow from the enclosure to the coupling via the collection pipe.

2. The exhaust handling system of claim 1, wherein the cap is connected to the exhaust stack such that the cap is supported by the exhaust stack.

3. The exhaust handling system of claim 2, wherein the cap is welded to the exhaust stack.

4. The exhaust handling system of claim 1, further comprising a vent, connected to the cap, wherein the vent at least partially defines the first flow path, and wherein the vent includes at least one valve member that is configured to actuate between:

an open position to emit exhaust to the atmosphere via the first flow path, and a closed position to prevent emission of exhaust to the atmosphere via the first flow path.

5. The exhaust handling system of claim 4, wherein the vent comprises a pressure-actuated vent.

6. The exhaust handling system of claim 4, wherein the at least one valve member comprises a plurality of louvers that are rotatable to transition the vent between the open position and the closed position.

7. The exhaust handling system of claim 1, wherein the coupling is proximate to a deck of the marine vessel.

8. The exhaust handling system of claim 7, further comprising a cleanout port positioned along the collection pipe that is proximate to the deck of the marine vessel, and wherein the cleanout port is configured to provide access into the collection pipe independent of the coupling.

9. The exhaust handling system of claim 1, further comprising a pipe connection positioned within the enclosure that is in fluid communication with the exhaust pipe such that exhaust pipe is configured to output exhaust into the pipe connection, and wherein the pipe connection is connected to the collection pipe such that exhaust emitted from the exhaust pipe is routed into the collection pipe via the pipe connection.

10. The exhaust handling system of claim 1, wherein the collection pipe comprises flexible ductwork.

11. An exhaust handling system for a marine vessel, the exhaust handling system comprising:

a cap connected to a top end portion of an exhaust stack of the marine vessel such that the cap is supported by the exhaust stack and such that the cap forms an enclosure that at least partially surrounds an outlet of an exhaust pipe extending through the exhaust stack;

a pressure-actuated vent in fluid communication with the enclosure; and a collection pipe in fluid communication with the enclosure to receive exhaust therefrom and configured to connect to an exhaust cleaning assembly that includes at least one tank to receive the exhaust.

12. The exhaust handling system of claim 11, wherein the pressure-actuated vent includes at least one valve member that is actuatable to selectively emit exhaust from the enclosure to an atmosphere surrounding the cap.

13. The exhaust handling system of claim 11, wherein the pressure-actuated vent is positioned on a top end of the cap.

14. The exhaust handling system of claim 11, wherein the pressure-actuated vent is positioned along the collection pipe.

15. The exhaust handling system of claim 11, wherein the cap is welded to the exhaust stack.

16. The exhaust handling system of claim 11, further comprising a coupling connected to the collection pipe that is configured to connect to a conduit of the exhaust cleaning assembly, wherein the coupling is accessible from a deck of the marine vessel, wherein the collection pipe comprises a cleanout port that is accessible from the deck of the marine vessel, and wherein the cleanout port is configured to provide access into the collection pipe independent of the coupling.

17. The exhaust handling system of claim 11, further comprising a pipe connection positioned within the enclosure that is in fluid communication with the exhaust pipe such that the exhaust pipe is configured to output exhaust to the collection pipe via the pipe connection.

18. A method comprising:

(a) positioning a marine vessel in a berthing location, the marine vessel including a deck, an exhaust stack having a top end portion positioned above the deck, an exhaust pipe extending through the exhaust stack to an outlet that is positioned above the top end portion of the exhaust stack, a cap connected to the exhaust stack so as to form an enclosure that at least partially surrounds the outlet of the exhaust pipe, and a collection pipe in fluid communication with the enclosure to receive exhaust therefrom;

(b) connecting an exhaust cleaning assembly to the collection pipe after (a), the exhaust cleaning assembly including at least one tank to receive the exhaust; and (c) operating the marine vessel to flow an exhaust emitted from the outlet of the exhaust pipe to the exhaust cleaning assembly after (b) via the collection pipe.

19. The method of claim 18, further comprising:

(d) emitting the exhaust out of the enclosure through a vent to atmosphere surrounding the cap during (a).

20. The method of claim 19, wherein (d) comprises flowing the exhaust out of a pressure-actuated vent in fluid communication with the enclosure.

21. The method of claim 18, further comprising:

(e) disconnecting the exhaust cleaning assembly from the collection pipe;

(f) moving the marine vessel away from the berthing location after (e); and (g) flowing the exhaust out of the enclosure to atmosphere during (f).

22. The method of claim 18, wherein (b) comprises connecting a conduit connected to the exhaust cleaning assembly to a coupling that is connected to the collection pipe and that is proximate to the deck of the marine vessel.

23. The method of claim 18, further comprising preventing the exhaust from flowing from the enclosure to atmosphere surrounding the cap during (c).

24. A method comprising:

(a) positioning a marine vessel in a berthing location, the marine vessel including an exhaust stack, an exhaust pipe extending through the exhaust stack to an outlet that is positioned above a top end portion of the exhaust stack, and a cap that is connected to the exhaust stack to form an enclosure that surrounds the outlet of the exhaust pipe;

(b) flowing an exhaust from the enclosure to atmosphere surrounding the cap via a first flow path during (a), the first flow path at least partially defined by the cap;

(c) connecting an exhaust cleaning assembly positioned at the berthing location to the cap after (a), the exhaust cleaning assembly including at least one tank to receive the exhaust; and (d) flowing the exhaust from the enclosure to the exhaust cleaning assembly via a second flow path after (b), the second flow path at least partially defined by the cap.

25. The method of claim 24, wherein (b) further comprises flowing the exhaust out of a vent connected to the enclosure.

26. The method of claim 25, wherein the vent includes at least one louver, and wherein (b) further comprises rotating the at least one louver of the vent to open the vent.

27. The method of claim 24, further comprising:

(e) disconnecting the exhaust cleaning assembly from the cap;

(f) moving the marine vessel away from the berthing location after (e); and (g) flowing the exhaust out of the enclosure to the atmosphere via the first flow path during (f).

28. The method of claim 24, wherein (c) comprises connecting a conduit connected to the exhaust cleaning assembly to a coupling that is proximate to a deck of the marine vessel and that is in fluid communication with the enclosure.

29. The method of claim 24, further comprising preventing the exhaust from flowing from the enclosure to the atmosphere during (d).

30. The method of claim 24, wherein the exhaust cleaning assembly is positioned on a barge that is positioned at the berthing location.

* * * * *